US012805678B2

(12) United States Patent
Kim et al.

(10) Patent No.: US 12,805,678 B2
(45) Date of Patent: Nov. 24, 2026

(54) CLEANER WITH DETACHABLE CONTROLLER

(71) Applicant: Samsung Electronics Co., Ltd., Suwon-si (KR)

(72) Inventors: Donghan Kim, Suwon-si (KR); Hyunjae Kwon, Suwon-si (KR); Jinho Lee, Suwon-si (KR); Seokbong Baek, Suwon-si (KR); Seongu Lee, Suwon-si (KR); Jonggook Lim, Suwon-si (KR); Byunghun Jung, Suwon-si (KR); Yunwon Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 316 days.

(21) Appl. No.: 18/243,892

(22) Filed: Sep. 8, 2023

(65) Prior Publication Data

US 2024/0180378 A1 Jun. 6, 2024

Related U.S. Application Data

(63) Continuation of application No. PCT/KR2023/013379, filed on Sep. 7, 2023.

(30) Foreign Application Priority Data

Dec. 6, 2022 (KR) ..... 10-2022-0169107
Apr. 13, 2023 (KR) ..... 10-2023-0048917

(51) Int. Cl.
*A47L 9/14* (2006.01)
*A47L 5/24* (2006.01)
*A47L 9/28* (2006.01)

(52) U.S. Cl.
CPC ..... *A47L 9/1427* (2013.01); *A47L 5/24* (2013.01); *A47L 9/2857* (2013.01); *A47L 9/2884* (2013.01)

(58) Field of Classification Search
CPC ..... A47L 9/1427; A47L 5/24; A47L 9/2857
See application file for complete search history.

(56) References Cited

U.S. PATENT DOCUMENTS 11,089,932 B2 8/2021 Hwang et al.
11,103,116 B2 * 8/2021 Lawson Mclean ..... A47L 9/127
(Continued)

FOREIGN PATENT DOCUMENTS

CN 108778082 A 11/2018
CN 109276185 A 1/2019
(Continued)

OTHER PUBLICATIONS

CN-215383690-U—English Machine Translation (Year: 2022).*
(Continued)

*Primary Examiner* — Marc Carlson
(74) *Attorney, Agent, or Firm* — STAAS & HALSEY LLP

(57) ABSTRACT

A cleaner including a main body; a suction fan in the main body and configured to generate a suction force for sucking in air; a dust collector in the main body and configured to separate foreign substances from the air that was sucked in; a filter housing detachably coupled to a rear of the main body; a filter in the filter housing and configured to filter the air from which foreign substances have been separated by the dust collector; and a controller detachably coupled to a rear of the filter housing, and including a manipulation unit to receive a manipulation input from a user to control an operation of the cleaner and/or an indication unit to display information about an operating state of the cleaner.

18 Claims, 24 Drawing Sheets

(56) References Cited

U.S. PATENT DOCUMENTS

| | | | | |
|---|---|---|---|---|
| 11,116,375 | B2 | 9/2021 | King et al. | |
| 11,160,425 | B2 * | 11/2021 | Brown | A47L 9/2857 |
| 11,478,119 | B2 | 10/2022 | Irfan et al. | |
| 2014/0359966 | A1 | 12/2014 | Han et al. | |
| 2015/0265120 | A1 * | 9/2015 | Han | B01D 46/48 55/482 |
| 2018/0184861 | A1 * | 7/2018 | Brown | A47L 9/0466 |
| 2019/0183305 | A1 * | 6/2019 | Lawson Mclean | A47L 5/24 |
| 2021/0113045 | A1 * | 4/2021 | Hwang | A47L 9/2842 |
| 2021/0290015 | A1 | 9/2021 | Conrad | |
| 2022/0211238 | A1 * | 7/2022 | Lee | H05K 5/003 |
| 2023/0219183 | A1 | 7/2023 | Caspar | |
| 2024/0180380 | A1 * | 6/2024 | Lee | A47L 9/1427 |
| 2024/0206130 | A1 * | 6/2024 | Lee | H01M 50/247 |

FOREIGN PATENT DOCUMENTS

| | | | | |
|---|---|---|---|---|
| CN | 208659173 | U * | 3/2019 | |
| CN | 215383690 | U * | 1/2022 | |
| CN | 114732314 | A * | 7/2022 | G06F 3/0487 |
| CN | 115120138 | A | 9/2022 | |
| EP | 2 628 431 | B1 | 10/2018 | |
| EP | 3 488 748 | A1 | 5/2019 | |
| EP | 3 718 452 | A1 | 10/2020 | |
| JP | 2019-187581 | | 10/2019 | |
| KR | 10-2014-0144435 | | 12/2014 | |
| KR | 10-2018-0023271 | | 3/2018 | |
| KR | 10-1903253 | | 10/2018 | |
| KR | 10-2138214 | | 7/2020 | |
| KR | 10-2020-0099188 | | 8/2020 | |
| KR | 10-2022-0156113 | | 11/2022 | |
| KR | 10-2469126 | | 11/2022 | |
| KR | 10-2606580 | | 11/2023 | |
| KR | 10-2613508 | | 12/2023 | |

OTHER PUBLICATIONS

International Search Report, PCT/ISA/210, dated Dec. 6, 2023, in PCT Application No. PCT/KR2023/013379.

Written Opinion, PCT/ISA/237, dated Dec. 6, 2023, in PCT Application No. PCT/KR2023/013379.

European Search Report dated Feb. 12, 2026, in European Application No. 23900830.3.

* cited by examiner

CLEANER WITH DETACHABLE CONTROLLER

CROSS-REFERENCE TO RELATED APPLICATIONS

This is a continuation application, filed under 35 U.S.C. § 111(a), of International Application PCT/KR2023/013379, filed Sep. 7, 2023, it being further noted that foreign priority benefit is based upon Korean Patent Application No. 10-2022-0169107, filed Dec. 6, 2022 and Korean Patent Application No. 10-2023-0048917, filed Apr. 13, 2023, in the Korean Intellectual Property Office, the disclosures of which are incorporated by reference herein in their entireties.

TECHNICAL FIELD

The disclosure relates to a cleaner.

BACKGROUND ART

A cleaner, for example, a vacuum cleaner, sucks in air containing foreign substances such as dust by using negative pressure, separates the foreign substances from the sucked-in air, and collects the foreign substances in a dust collection container. A cordless cleaner may include a battery. The cordless cleaner may receive power from the battery to perform a cleaning operation. The cleaner includes a controller for controlling the operation of the cleaner. A user may control the operation of the cleaner, such as powering on/off, by using the controller.

DESCRIPTION OF EMBODIMENTS

Technical Solution to Problem

According to an aspect of the disclosure, a cleaner may include a main body; a suction fan in the main body and configured to generate a suction force for sucking in air; a dust collector in the main body and configured to separate foreign substances from the air that was sucked in; a filter housing detachably coupled to a rear of the main body; a filter in the filter housing and configured to filter the air from which foreign substances have been separated by the dust collector; and a controller detachably coupled to a rear of the filter housing, and including a manipulation unit to receive a manipulation input from a user to control an operation of the cleaner and/or an indication unit to display information about an operating state of the cleaner.

According to an aspect of the disclosure, the filter housing may be configured to be detachable from the rear of the main body in a backward direction.

According to an aspect of the disclosure, a form factor of the controller may be greater than a corresponding form factor of the filter housing.

According to an aspect of the disclosure, the cleaner may further include a socket detachably coupling the controller to the rear of the filter housing.

According to an aspect of the disclosure, the socket may be in the filter housing.

According to an aspect of the disclosure, the cleaner may further include a first guide in the socket; and a second guide in the controller and having a shape complementary to a shape of the first guide so as to be guidable by the first guide to couple and detach the controller to the rear of the filter housing.

According to an aspect of the disclosure, the controller may be configured to be coupled to, and detached from, the socket by being slid in an upward direction and a downward direction, respectively.

According to an aspect of the disclosure, the cleaner may further include a handle that is grippable by a user, wherein the controller, when coupled to the rear of the filter housing, is above the handle.

According to an aspect of the disclosure, the controller may include a locking unit configured to be inserted into the handle upon the controller being coupled to the rear of the filter housing, and a locking hole, and the handle may have a screw fastening hole that, when the controller is coupled to the rear of the filter housing, is aligned with the locking hole. The cleaner may further include a screw, that, when the controller is coupled to the rear of the filter housing, is screwed into the locking hole through the screw fastening hole.

According to an aspect of the disclosure, the cleaner may further include a cover detachably coupled to the handle to cover the screw fastening hole.

According to an aspect of the disclosure, the cleaner may include a handle that is grippable by a user, and the controller may be coupled to the handle so that, when the controller is coupled to and detached from the rear of the filter housing, the handle is configured to be coupled to and detached from the main body, respectively.

According to an aspect of the disclosure, the cleaner may further include a handle that is grippable by a user, and the handle, the filter housing, and the controller may be coupleable together as a unit so that, when the handle, the filter housing, and the controller are coupled together as a unit, the handle and the filter housing are coupleable to and detachable from the main body and the controller is coupleable to and detachable from the rear of the filter housing.

According to an aspect of the disclosure, the controller and the filter housing may be configured so that, while the controller is coupled to the rear of the filter housing, the filter housing is detachable from the main body.

According to an aspect of the disclosure, a cleaner may include a main body; a suction fan in the main body and configured to generate a suction force for sucking in air; a dust collector in the main body and configured to separate foreign substances from the air that was sucked in; a filter housing coupled to the main body and configured to be detachable from the main body in a backward direction; a filter in the filter housing and configured to filter the air from which foreign substances have been separated by the dust collector; and a controller including a manipulation unit to receive a manipulation input from a user to control an operation of the cleaner and/or an indication unit to display information about an operating state of the cleaner, wherein the controller may be located at a rear of the filter housing, and the controller may be switchable between a use position and a retreat position in which the controller does not interfere with the filter housing being detached from the main body in the backward direction.

According to an aspect of the disclosure, the controller may be rotatable to the use position and the retreat position.

According to an aspect of the disclosure, the cleaner may further include a hinge that includes a shaft and is configured to rotate the controller forward and backward to the use position and the retreat position, respectively.

According to an aspect of the disclosure, the cleaner may further include a hinge that includes a shaft and is configured to rotate the controller in a lateral direction to the use position and the retreat position.

According to an aspect of the disclosure, the cleaner may further include a handle that is grippable by a user, wherein the controller is coupled to the handle.

According to an aspect of the disclosure, the handle may be rotatably supported by the main body, and the controller may be configured to switch to the use position and the retreat position as the handle is rotated.

According to an aspect of the disclosure, the controller may have a flexible structure so as to be bendable from the use position to the retreat position.

MODE OF DISCLOSURE

Figure 1:
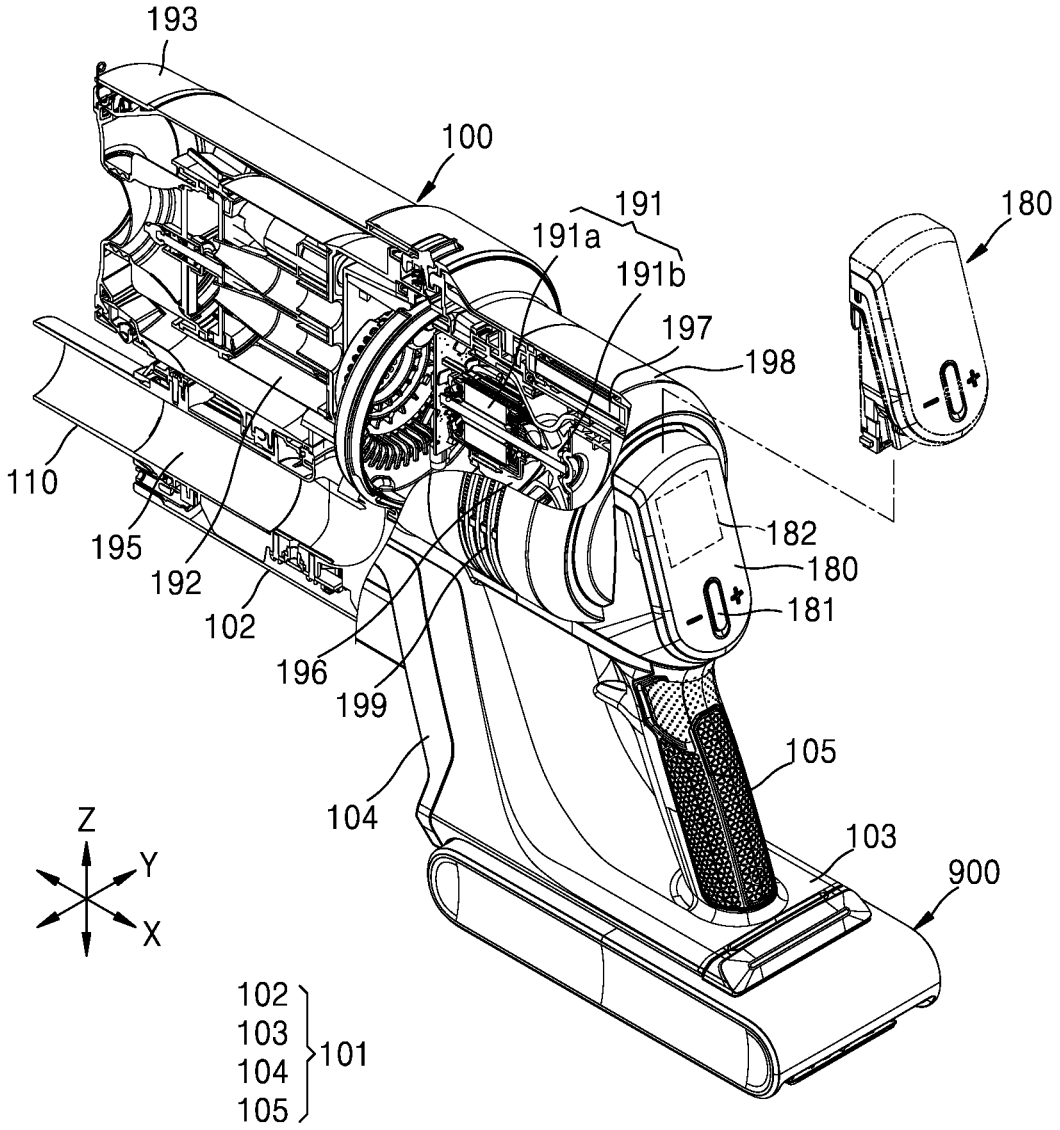
FIG. 1 is a schematic partial cross-sectional perspective view of a cleaner according to an embodiment of the disclosure.

As used herein, the expression "at least one of a, b, or c" may indicate only a, only b, only c, both a and b, both a and c, both b and c, all of a, b, and c, or variations thereof.

It should be appreciated that various embodiments of the disclosure and the terms used therein are not intended to limit the technological features set forth herein to particular embodiments of the disclosure, and include various changes, equivalents, or alternatives for a corresponding embodiment.

With regard to the description of the drawings, similar reference numerals may be used to refer to similar or related elements.

A singular form of a noun corresponding to an item may include one or more of the things, unless the relevant context clearly indicates otherwise.

As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases.

As used herein, the term "and/or" includes any one or a combination of a plurality of related recited elements.

As used herein, such terms as "1st" and "2nd," or "first" and "second" may be used to simply distinguish a corresponding component from another, and does not limit the components in other aspect (e.g., importance or order).

When an element (e.g., a first element) is referred to, with or without the term "operatively" or "communicatively", as being "coupled with," "coupled to," "connected with," or "connected to" another element (e.g., a second element), it means that the element may be connected to the other element directly (e.g., in a wired manner), wirelessly, or via a third element.

As used here, such terms as "comprises," "includes," or "has" specify the presence of stated features, numbers, stages, operations, components, parts, or a combination thereof, but do not preclude the presence or addition of one or more other features, numbers, stages, operations, components, parts, or a combination thereof.

When an element is referred to as being "connected to," "coupled to," "supported by," or "in contact with" another element, it means that the element is directly connected to, coupled to, supported by, or in contact with the other element, or that the element is indirectly connected to, coupled to, supported by, or in contact with the other element via a third element.

When an element is referred to as being "on" another element, it means that the element is in contact with the other element, or that still another element is present between the element and the other element.

A cleaner, for example, a vacuum cleaner, sucks in air with foreign substances such as dust through a suction force generated by a suction fan, filters the foreign substances out of the air, and accommodates the foreign substances in a dust collection container. A cordless cleaner receives power from a battery to perform a cleaning operation. The battery is detachable from the cordless cleaner. A controller is provided in the cleaner. Control of the operation of the cleaner, such as powering on/off, may be performed by using the controller. As the conditions of use of the cleaner vary, the shape and function of the controller may also vary. The disclosure provides a cleaner having a structure in which a controller is detachable from the cleaner. The aesthetic elements of the cleaner may be improved by detaching the controller from the top of the cleaner and replacing the controller with another controller having a different design, according to a user's preferences. In addition, the convenience of use and manipulability of the cleaner may be improved by mounting, on the cleaner, a controller having a manipulation unit and an indication unit suitable for the conditions of use of the cleaner.

The cleaner includes a filter that finally filters fine dust out of air that has passed through a dust collector. The filter is installed in a filter housing. In order to replace the filter, the filter housing may be separated from the main body of the cleaner. In the cleaner of the disclosure, the filter housing is separated from the cleaner in the backward direction. The cleaner includes a handle to be held by the user. The controller is arranged at the rear of the filter housing to allow the user holding the handle to easily manipulate the controller. The structure in which the controller is detachable from the cleaner enables the use of various controllers and the separation of the filter housing from the rear of the cleaner.

The performance of the cleaner is affected by the resistance of an air flow path (i.e., flow path resistance). For a cordless cleaner using a rechargeable battery, suction efficiency and battery efficiency may be improved by reducing the flow path resistance. The cleaner of the disclosure has a reverse motor structure in which an impeller is located downstream of a suction motor. As the flow resistance against air sucked in by the suction fan and discharged through the filter is improved, the battery efficiency relative to output may increase, and with the improvement of the battery efficiency, the use time of the vacuum cleaner that requires to be recharged before use may increase.

Hereinafter, embodiments of the disclosure will be described in detail with reference to the accompanying drawings. Like reference numerals in the drawings indicate parts or components that perform substantially the same functions.

FIG. 1 is a schematic partial cross-sectional perspective view of a cleaner according to an embodiment of the disclosure. The exemplary cleaner illustrated in FIG. 1 is a stick-type cordless cleaner. Referring to FIG. 1, the cleaner may include a main body 100 and a controller 180 for controlling the operation of the cleaner. The main body 100 may include a suction fan 191 to generate a suction force for sucking in air, a dust collector 192 to separate foreign substances from the sucked-in air, and a filter 197 to filter foreign substances out of the air that has passed through the dust collector 192. The filter 197 is accommodated in a filter housing 198. The controller 180 is located at the rear of the filter housing 198. The controller 180 is detachable from the main body 100.

The main body 100 may include an extension pipe coupling unit 110 to which an extension pipe (not shown) is coupled. A suction nozzle (not shown) is detachably connected to one end of the extension pipe. The other end of the extension pipe may be detachably coupled to the extension pipe coupling unit 110 of the main body 100. The extension pipe connects the main body 100 to the suction nozzle to form a passage through which air and foreign substances sucked in through the suction nozzle move to the main body 100. The suction fan 191 to generate a suction force required to suck in air with foreign substances on a surface to be cleaned, the dust collector 192 to separate the foreign substances from the sucked-in air, a dust collection container 193 in which the separated foreign substances are accommodated, and the filter housing 198 accommodating the filter 197 are provided in the main body 100.

The suction fan 191 may include a suction motor 191*a* and an impeller 191*b* mounted on a rotating shaft of the suction motor 191*a*. When the suction motor 191*a* is driven to rotate the impeller 191*b*, suction pressure is generated for sucking in air and foreign substances on the surface to be cleaned through an air intake path 195. The air is adiabatically compressed by the impeller 191*b* and thus rises in temperature. In a structure in which the impeller 191*b* is located upstream of the suction motor 191*a*, and the suction motor 191*a* is exposed to the high-temperature compressed air. The motor coil of the suction motor 191*a* is cooled by the sucked-in air, and the motor coil may not be effectively cooled when the high-temperature compressed air flows around the suction motor 191*a*. The high-temperature compressed air may rather cause the temperature of the motor coil to rise, and the power and efficiency of the suction motor 191*a* may deteriorate. The suction fan 191 according to the present embodiment of the disclosure has a reverse motor structure in which the impeller 191*b* is arranged downstream of the suction motor 191*a* with respect to the direction of air flow. According to the present embodiment of the disclosure, in the suction fan 191 having the reverse motor structure, low-temperature uncompressed air passes through the surroundings of the suction motor 191*a*. The low-temperature air may effectively cool the motor coil. The motor coil may be maintained at a stable operating temperature, and thus, the power and efficiency of the suction motor 191*a* may be improved.

The air intake path 195 connecting the extension pipe coupling unit 110 to the dust collector 192 is provided in the main body 100. The foreign substances and air sucked in through the suction nozzle by the suction force generated by the suction fan 191 are moved to the dust collector 192 via the extension pipe, the extension pipe coupling unit 110, and the air intake path 195. The dust collector 192 may have, for example, a cyclone dust collection structure. The dust collector 192 may be located between the dust collection container 193 and the suction fan 191, with respect to the flow path of the sucked-in air. The foreign substances are separated from the sucked-in air by the dust collector 192 and then accommodated in the dust collection container 193. The dust collection container 193 is detachable from the main body 100. For example, the dust collection container 193 may be separated from the main body 100 by pulling a front portion of the dust collection container 193. After separating the dust collection container 193 from the main body 100, foreign substances collected in the dust collection container 193 may be removed.

An exhaust path 196 for discharging the air from which the foreign substances are removed is provided in the main body 100. The exhaust path 196 is provided downstream of the suction fan 191. The filter 197 may be provided at the inlet of the exhaust path 196, in the exhaust path 196, or at the outlet of the exhaust path 196. In the present embodiment of the disclosure, the filter 197 is provided at the outlet of the exhaust path 196. There is no particular limitation on the type of the filter 197. The filter 197 may include, for example, a high-efficiency particulate air (HEPA) filter. The filter 197 may filter out ultra-fine dust or the like that has not been filtered out by the dust collector 192. The filter 197 may be accommodated in the filter housing 198. The air from which the foreign substances are removed may be discharged to the outside after passing through the exhaust path 196 and the filter 197. An exhaust port 199 through which the air that has passed through the exhaust path 196 and the filter 197 is discharged may be provided in the filter housing 198.

The filter housing 198 may be detachable from the main body 100 for maintenance of the filter 197, such as cleaning or replacement. The filter housing 198 may have a front separation structure in which the filter housing 198 is moved forward to be separated from the main body 100. The front separation structure is disadvantageous in terms of user convenience in that the dust collection container 193 needs to be separated from the main body 100 first in order to separate the filter housing 198 from the main body 100. In addition, because the filter 197 needs to be located relatively far forward from the outlet of the suction fan 191, the curvature of the exhaust path 196 may be high, resulting in an increase in the flow path resistance. This may cause a deterioration in the suction efficiency of the suction fan 191. In the cleaner of the present embodiment of the disclosure, the filter housing 198 has a backward separation structure in which the filter housing 198 is moved backward to be separated from the main body 100. That is, the filter housing 198 is detachable from the main body 100 in the backward direction. The backward separation structure is advantageous in terms of user convenience in that the filter housing 198 may be separated from the main body 100 without separating the dust collection container 193 from the main body 100. In addition, because the filter 197 may be located close to the outlet of the suction fan 191, the curvature of the exhaust path 196 may be low, and thus, the flow path resistance may be less than that of the front separation structure. Accordingly, the suction efficiency of the suction fan 191 may be improved. After separating the filter housing 198 from the main body 100, the filter 197 accommodated in the filter housing 198 may be replaced with a new filter 197. Alternatively, the filter 197 accommodated in the filter housing 198 may be cleaned.

The main body 100 includes frames 101 to support or accommodate the above-described components of the cleaner. For example, the frames 101 may include a prop 102 extending in the forward or backward direction (X), a battery mount 103 extending in the forward or backward direction (X) parallel to the prop 102, and a support 104 connecting the prop 102 to the battery mount 103. The prop 102 may extend in the backward directions (X) beyond the support 104. The dust collection container 193, the dust collector 192, the suction fan 191, and the filter housing 198 may be arranged in the forward or backward direction (X) above the prop 102. The extension pipe coupling unit 110 may be provided at the front of the prop 102. The air intake path 195 is provided inside the prop 102 and extends from the extension pipe coupling unit 110 to the dust collector 192. The exhaust path 196 may be provided downstream of the suction fan 191 and above the prop 102. A battery 900 may be mounted on or separated from the battery mount 103. The support 104 may connect the front end of the battery mount 103 to the prop 102. For example, the support 104 may be inclined toward the front from the lower end to the upper end.

The main body 100 may include a handle 105 that may be gripped by a user. The user holding the handle 105 may move and manipulate the cleaner. The handle 105 may be located at the rear of the support 104. For example, the handle 105 may connect the rear end of the battery mount 103 to the rear end of the prop 102. The handle 105 may be inclined toward the front from the lower end to the upper end, considering ease of use. For example, the upper end of the handle 105 may form an obtuse angle with the prop 102, and the lower end of the handle 105 may form an acute angle with the battery mount 103. The handle 105 may have a size suitable for the user to comfortably grip the handle 105.

The controller 180 is located at the rear of the filter housing 198. The controller 180 may be located near the rear end of the prop 102 and above the handle 105. The user gripping the handle 105 may use the cleaner. Here, the controller 180 may naturally come into the user's field of view and thus improve the convenience of use. In addition, the user may easily manipulate the controller 180 with the thumb of the hand holding the handle 105 or with the other hand.

The controller 180 may include a control circuit unit and a manipulation unit 181 for making a manipulation input such as powering on/off, adjusting the suction strength, or changing the operation mode. The controller 180 may further include an indication unit 182 configured to display information about the operating state of the cleaner. The manipulation unit 181 may include a physical button, a resistive or capacitive touch panel, and the like. The manipulation unit 181 may have a structure enabling manipulation input through speech recognition and manipulation input through communication with an external control device. The indication unit 182 may audibly and visually indicate the operating state of the cleaner and the like. For example, the indication unit 182 may include a beeper, a display, one or more light-emitting units, and the like. When employing a touch panel display, the manipulation unit 181 and the indication unit 182 may be integrated into one unit. The control circuit unit may control the cleaner according to a manipulation input through the manipulation unit 181, and may control the indication unit 182 to indicate information about the operating state of the cleaner, and the like.

As described above, the controller 180 is detachable from the main body 100. For example, the controller 180 may be attached to or detached from the main body 100 by being moved, for example, by being slid, in the forward or backward direction (X), a lateral direction (Y), or the upward or downward direction (Z).

Figure 2:
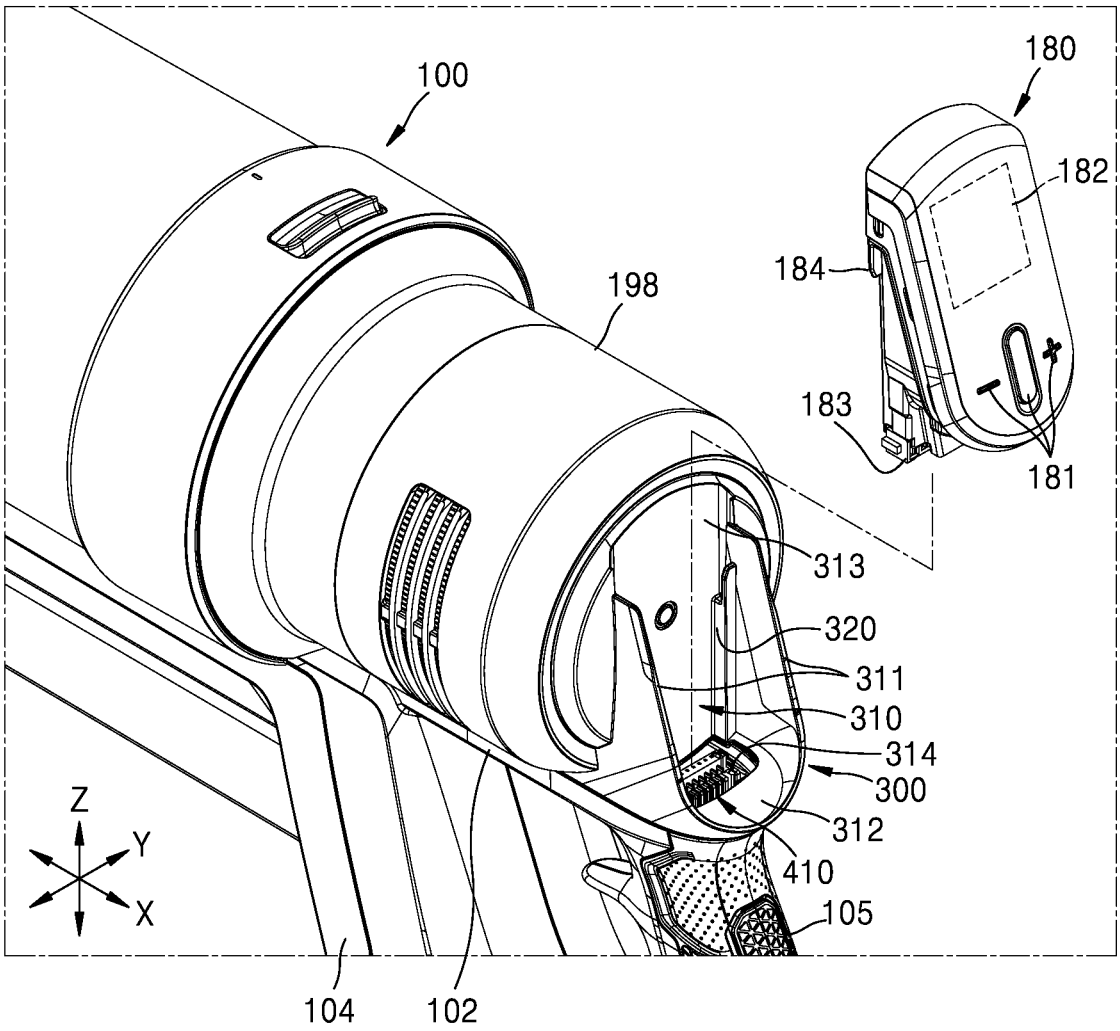
FIG. 2 is a partially exploded perspective view illustrating a structure in which a controller is attached to or detached from a cleaner in an upward or downward direction, according to an embodiment of the disclosure.

FIG. 2 is a partially exploded perspective view illustrating a structure in which the controller 180 is attached to or detached from a cleaner in the upward or downward direction (Z), according to an embodiment of the disclosure. Referring to FIG. 2, a socket 300 by which the controller 180 is detachably supported may be provided in the main body 100. For example, the socket 300 may be provided in the filter housing 198. For example, the socket 300 may be integrally formed with or coupled to the filter housing 198. Accordingly, the controller 180 is coupled to the filter housing 198 either directly or indirectly via the socket 300. The socket 300 includes an accommodation unit 310 in which the controller 180 is detachably accommodated. The accommodation unit 310 may extend in the upward or downward direction (Z) and may have an open top. For example, the accommodation unit 310 may be defined by a pair of side walls 311 spaced apart from each other in the lateral direction (Y), a lower wall 312 connecting the lower ends of the pair of side walls 311 to each other, and a front wall 313 connecting the front ends of the pair of side walls 311 to each other.

A first guide 320 is provided to guide the controller 180 being attached to or detached from the socket 300. The first guide 320 extends in the directions of attachment and detachment of the controller 180, i.e., in the upward and downward directions (Z). For example, the first guide 320 may be provided on each of the pair of side walls 311. A second guide 184 to be guided by the first guide 320 is provided in the controller 180. The first guide 320 and the second guide 184 may have complementary shapes for relative movements in the directions of attachment and detachment. For example, the first guide 320 may have a slot shape extending in the upward or downward direction (Z), and the second guide 184 may have a shape protruding from both sidewalls of the controller 180 in the lateral direction (Y) to be inserted into the first guide 320. Although not illustrated in the drawings, the first guide 320 may have a protruding shape, and the second guide 184 may have a slot shape. In addition to above examples, the first guide 320 and the second guide 184 may have various complementary shapes for relative movements in the directions of attachment and detachment.

Figure 3:
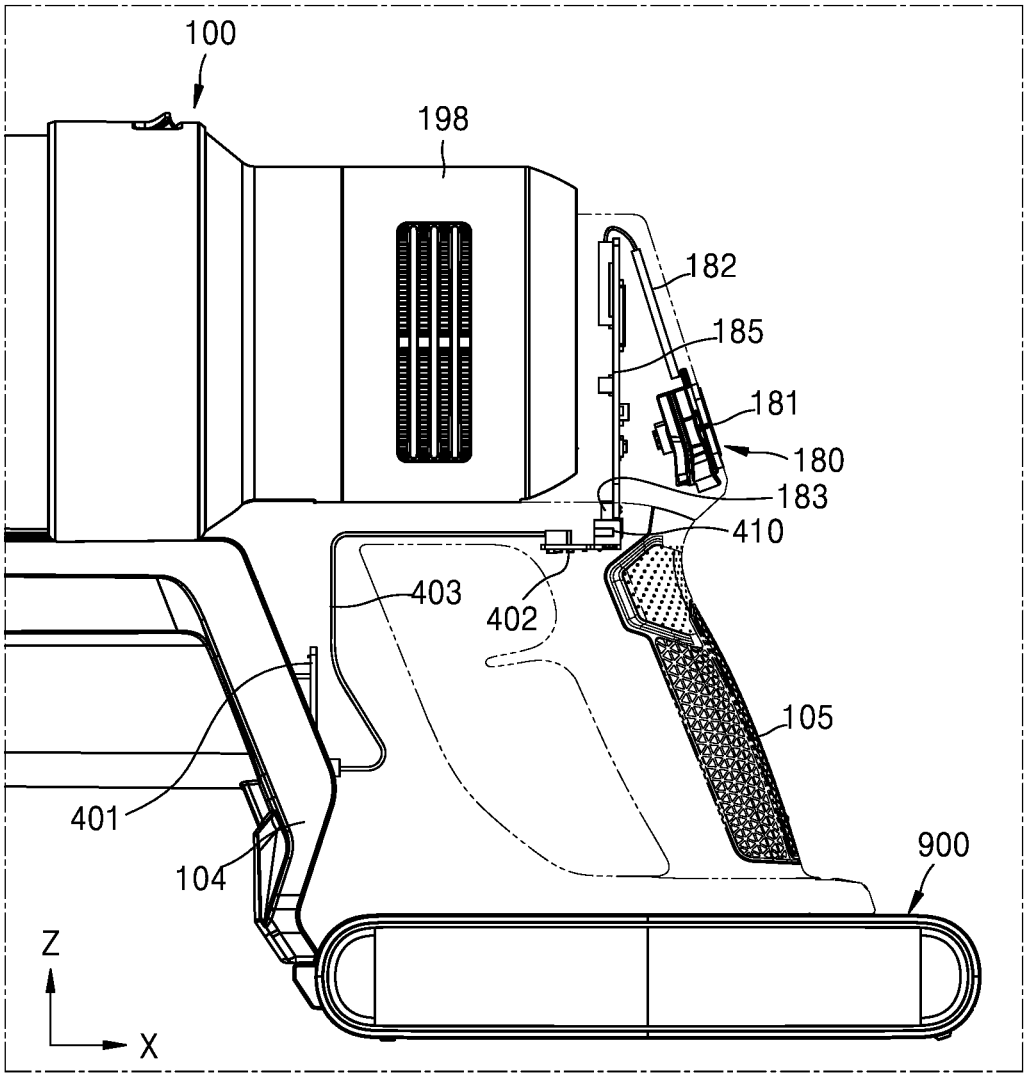
FIG. 3 is a schematic side view illustrating an electrical connection structure between a main body and a controller, according to an embodiment of the disclosure.

FIG. 3 is a schematic side view illustrating an electrical connection structure between the main body 100 and the controller 180, according to an embodiment of the disclosure. Referring to FIGS. 2 and 3, in order to electrically connect the main body 100 to the controller 180, a first connector 183 is provided in the controller 180. The controller 180 may include a printed circuit board 185 having a control circuit unit. One or more printed circuit boards 185 may be provided. The manipulation unit 181 and the indication unit 182 may be electrically connected to the printed circuit board 185 (e.g., a control circuit board) by a connecting unit (not shown), for example, a wire, a cable, a connector, or a flexible circuit board. The first connector 183 is provided on the printed circuit board 185. For example, the first connector 183 may be provided at the lower end of the printed circuit board 185. The first connector 183 may be of various types depending on its shape and connection method. For example, the first connector 183 may include, but is not limited to, a board-to-board (B-to-B) connector, a C-type connector, and a detachable connector for repetitive attachment and detachment.

A second connector 410 to engage the first connector 183 may be provided in the main body 100. The second connector 410 may be formed to be complementary to the first connector 183. A printed circuit board 401 (a first printed circuit board) is provided in the main body 100. The printed circuit board 401 is electrically connected to the battery 900 and control elements of the main body 100 including the suction motor 191*a* and sensors. For example, the printed circuit board 401 may be accommodated in the support 104. A printed circuit board 402 (a second printed circuit board) may be provided in the prop 102. The printed circuit board 402 may be located near the rear end of the prop 102. The second connector 410 is provided on the printed circuit board 402. The printed circuit board 401 and the printed circuit board 402 are electrically connected to each other by wires 403.

The second connector 410 is exposed to the inside of the accommodation unit 310 through an opening 314 provided in the lower wall 312 forming the accommodation unit 310. The controller 180 is inserted into the accommodation unit 310 by aligning the second guide 184 with the first guide 320 and moving the controller 180 downward. When the controller 180 is completely inserted into the accommodation unit 310, the first connector 183 engages the second connector 410. Accordingly, the controller 180 may communicate with the battery 900 and the control elements of the main body 100.

The controller 180 may be fixed to the main body 100 by various fixing structures. For example, the controller 180 may be fixed to the main body 100 by a snap-fit fixing structure, a magnetic fixing structure, a screw fastening structure, or the like.

Figure 4:
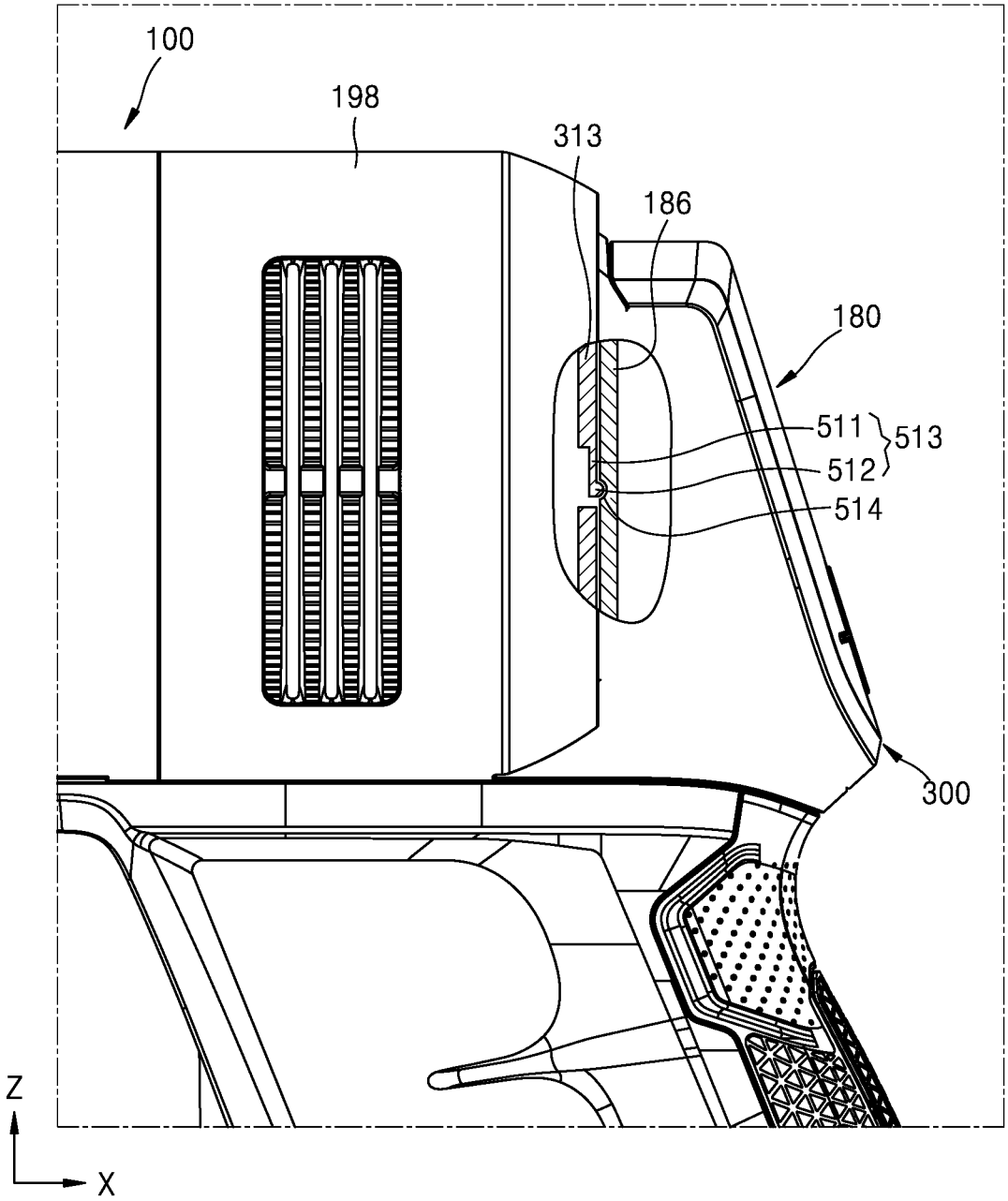
FIG. 4 illustrates a snap-fit fixing structure according to an embodiment of the disclosure.

FIG. 4 illustrates a snap-fit fixing structure according to an embodiment of the disclosure. Referring to FIG. 4, according to an embodiment of the disclosure, the snap-fit fixing structure may include a catching unit 514 provided in any one of the controller 180 and the socket 300, and an elastic locker 513 provided in the other one of the controller 180 and the socket 300 to be elastically caught by the catching unit 514. In the present embodiment of the disclosure, the catching unit 514 is provided in the controller 180, and the elastic locker 513 is provided in the socket 300. For example, the elastic locker 513 may include an elastic arm 511 provided on the front wall 313 of the socket 300 to be elastically bent in the forward or backward direction (X), and an engagement protrusion 512 provided at an end of the elastic arm 511. The catching unit 514 has a shape by which the engagement protrusion 512 may be caught. For example, the catching unit 514 may be concavely formed on a front wall 186 of the controller 180.

When the controller 180 is inserted into the accommodation unit 310 of the socket 300 and then slid downward, the front wall 186 of the controller 180 pushes the engagement protrusion 512 forward such that the elastic arm 511 is bent forward. When the mounting of the controller 180 is completed, the elastic arm 511 elastically returns to its original position and the engagement protrusion 512 is thus caught by the catching unit 514, such that the controller 180 may be fixed to the socket 300. The controller 180 may remain fixed to the socket 300 unless a force greater than or equal to the elastic force of the elastic arm 511 is applied. By sliding the controller 180 upward with a force greater than the elastic force of the elastic arm 511 in order to separate the controller 180 from the socket 300, the engagement protrusion 512 is pushed forward by the catching unit 514 and the elastic arm 511 is bent forward such that the engagement protrusion 512 is separated from the catching unit 514. By continuously sliding the controller 180 upward, the controller 180 may be separated from the accommodation unit 310 of the socket 300. When the controller 180 is detached from the socket 300, the elastic arm 511 elastically returns to its original position.

Figure 5:
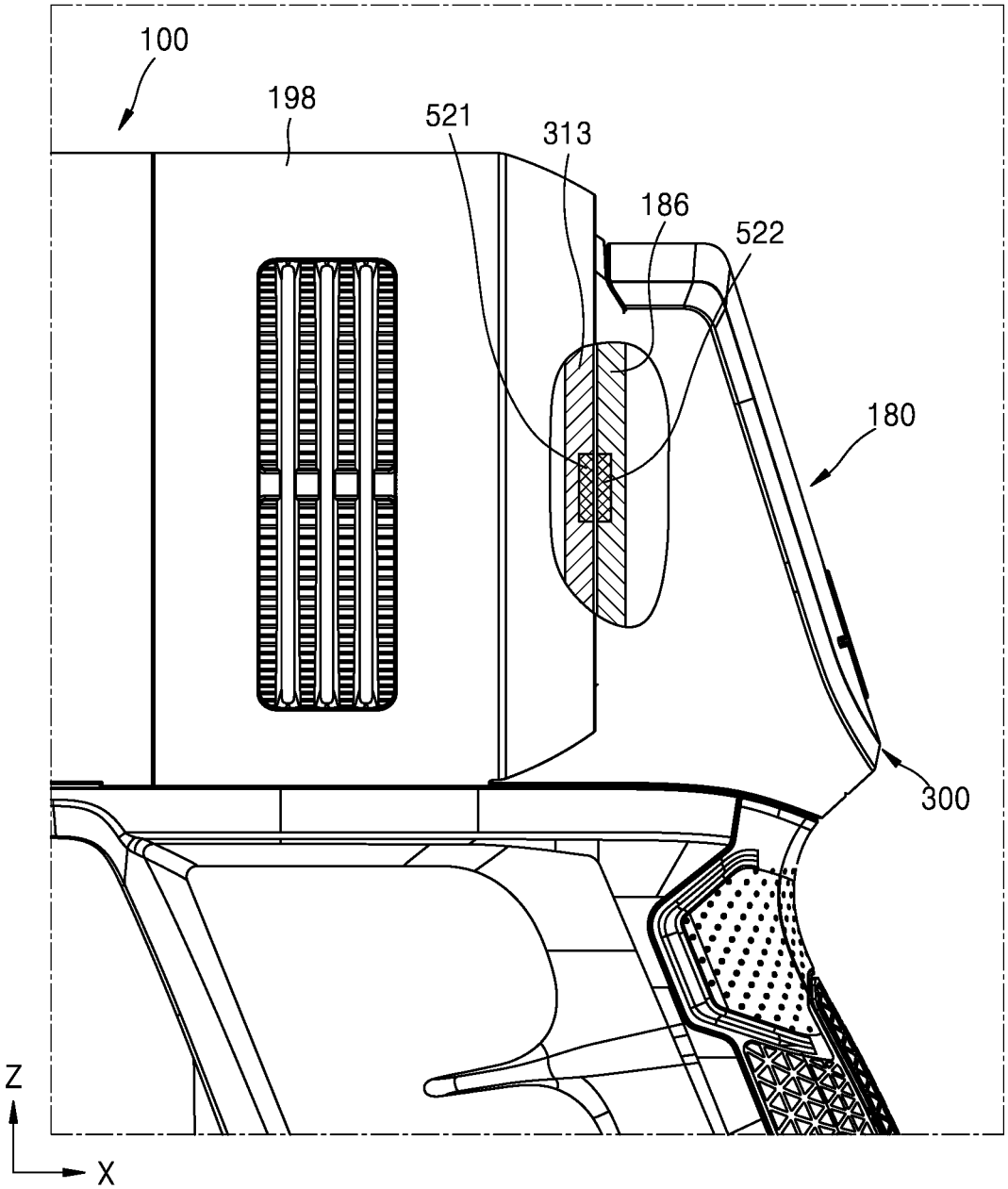
FIG. 5 illustrates a magnetic fixing structure according to an embodiment of the disclosure.

FIG. 5 illustrates a magnetic fixing structure according to an embodiment of the disclosure. Referring to FIG. 5, according to an embodiment of the disclosure, the magnetic fixing structure may include a magnet 521 provided in any one of the controller 180 and the socket 300, and a magnetic member 522 provided in the other one of the controller 180 and the socket 300. The magnetic member 522 is a member that is able to stick to the magnet 521, such as iron. In the present embodiment of the disclosure, the magnetic member 522 is provided in the controller 180, and the magnet 521 is provided in the socket 300. For example, the magnet 521 may be provided on the front wall 313 of the socket 300, and the magnetic member 522 may be provided on the front wall 186 of the controller 180 facing the front wall 313. When the controller 180 is inserted into the accommodation unit 310 of the socket 300, the magnetic member 522 may be attached to the magnet 521 by the magnetic force of the magnet 521, and the controller 180 may be fixed to the socket 300. By sliding the controller 180 upward with a force greater than the magnetic force of the magnet 521 in order to separate the controller 180 from the socket 300, the magnetic member 522 may be separated from the magnet 521, and the controller 180 may be separated from the accommodation unit 310 of the socket 300.

Figure 6:
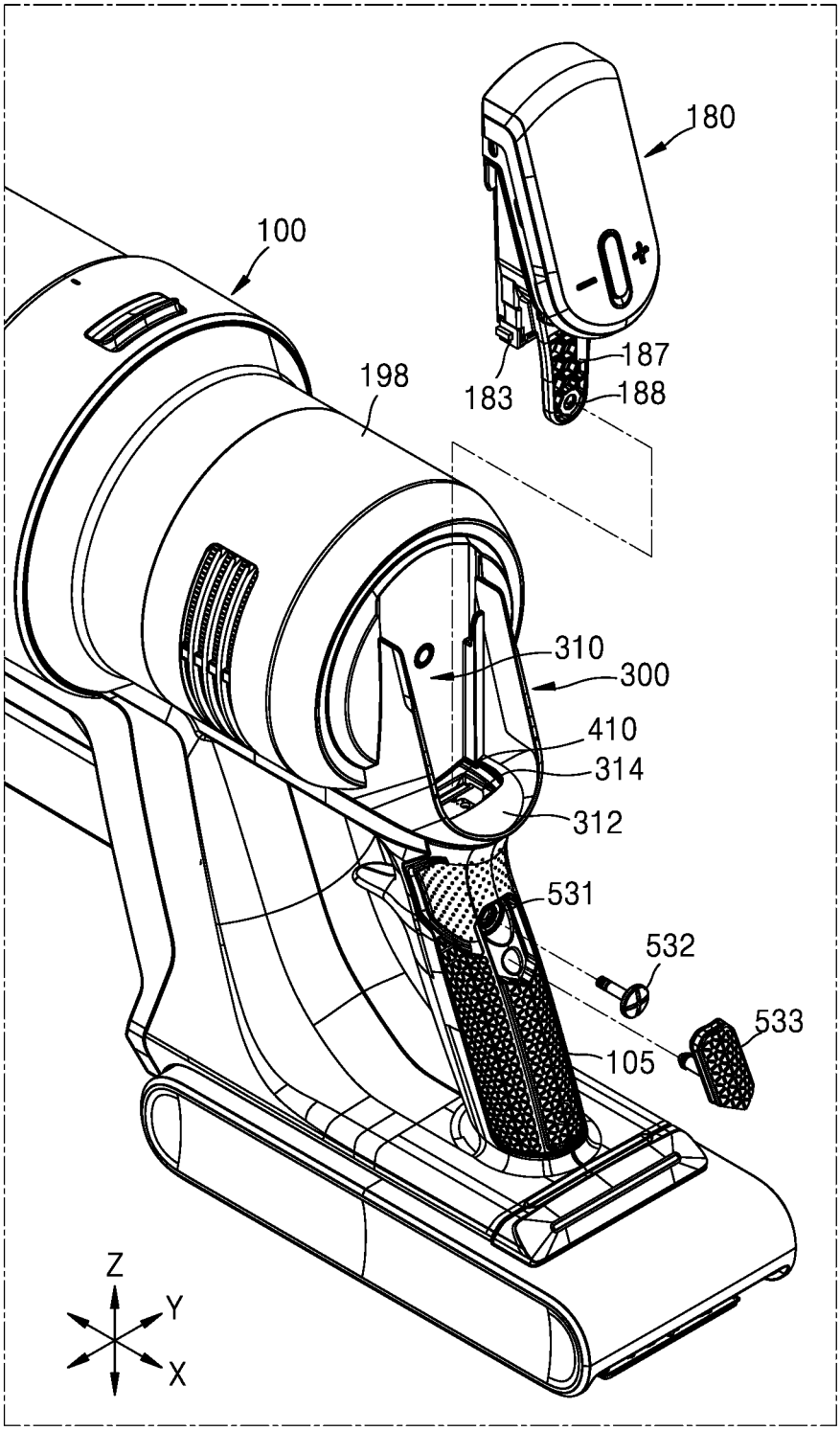
FIG. 6 illustrates a screw fastening structure according to an embodiment of the disclosure.

FIG. 6 illustrates a screw fastening structure according to an embodiment of the disclosure. Referring to FIG. 6, a locking unit 187 inserted into the handle 105 is provided in the controller 180. For example, the locking unit 187 extends downward from the lower end of the controller 180. The locking unit 187 may be located at the rear of the first connector 183. A locking hole 188 is provided in the locking unit 187. The opening 314 is provided in a lower portion of the socket 300, for example, in the lower wall 312. The second connector 410 described above is exposed upward through the opening 314. The opening 314 provides a passage through which the locking unit 187 is inserted into the handle 105.

When the controller 180 is mounted on the socket 300, the locking unit 187 is inserted into the handle 105 through the opening 314. A screw fastening hole 531 to be aligned with the locking hole 188 is provided in the handle 105. The controller 180 may be fixed to the main body 100 by tightening a screw 532 into the screw fastening hole 531 through the locking hole 188. A cover 533 may cover the screw fastening hole 531. The cover 533 may be detachably coupled to the handle 105. In order to maintain the appearance quality of the cleaner, the cover 533 may have a shape matching the appearance of the handle 105. The cover 533 may be formed of, for example, rubber or the like. The controller 180 may be separated from the main body 100 by separating the cover 533 from the handle 105, loosening the screw 532, and then sliding the controller 180 upward to separate it from the socket 300.

As the conditions of use of the cleaner vary, the shape and function of the controller 180 may also vary. According to the disclosure, the controller 180 is detachable from the main body 100. The aesthetic elements of the cleaner may be improved by detaching the controller 180 from the main body and replacing the controller 180 with another controller 180 having a different design, according to the user's preferences. In addition, the convenience of use and manipulability of the cleaner may be improved by mounting, on the cleaner, the controller 180 having the manipulation unit 181 and the indication unit 182 suitable for the conditions of use of the cleaner.

Figure 7A:
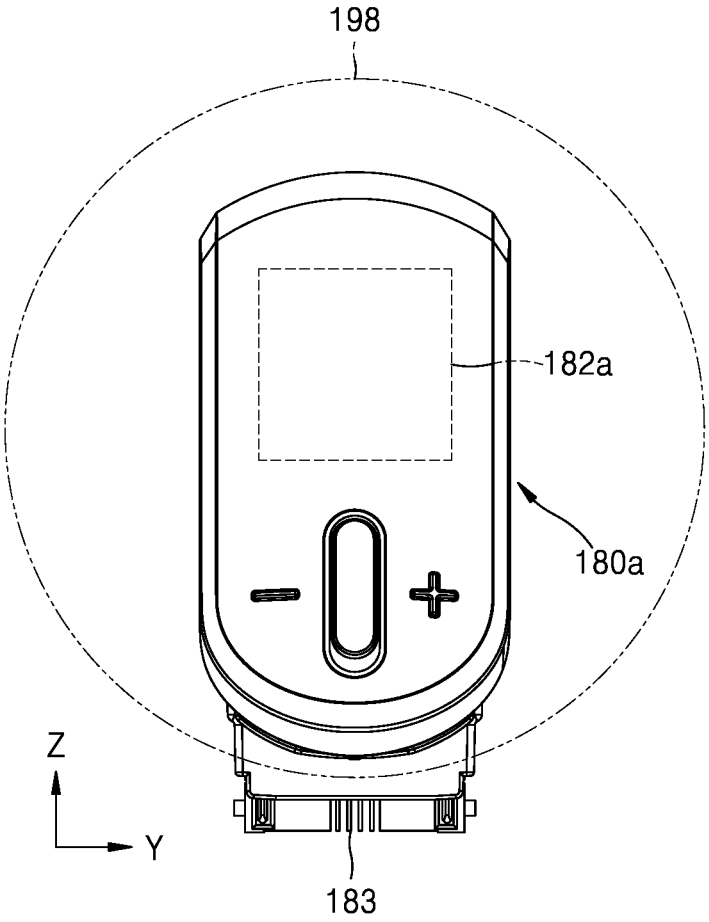
FIGS. 7A to 7E illustrate various examples of controllers.
Figure 7B:
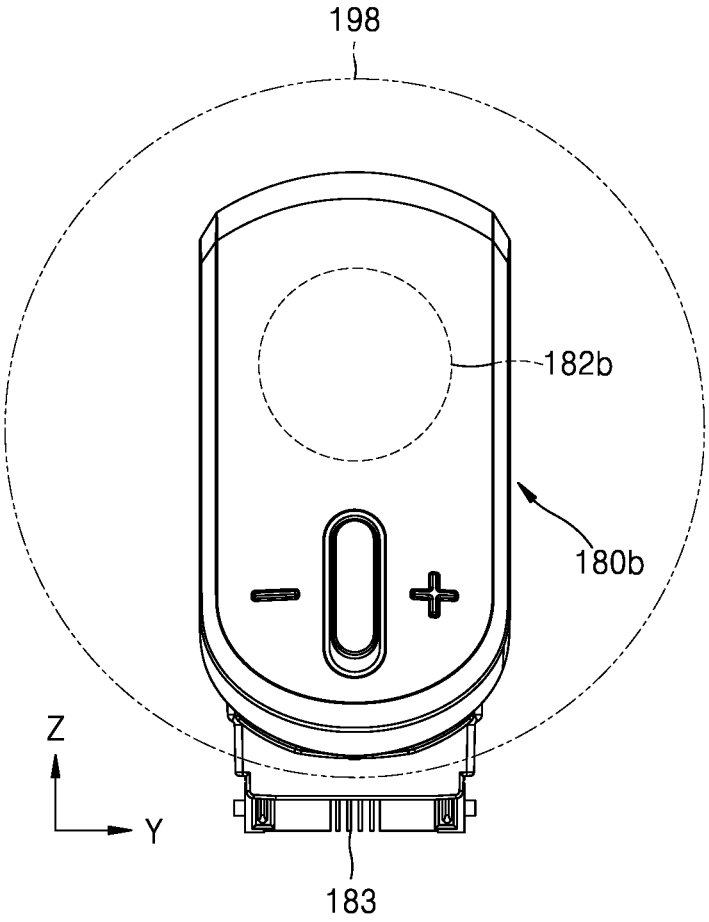

FIGS. 7A to 7E illustrate various examples of the controller 180. Referring to FIG. 7A, a controller 180*a* according to an embodiment of the disclosure is a general or standard controller having an indication unit 182*a* having a quadrangular shape and a standard size. The controller 180*a* may have form factors, for example, a length in the lateral direction (horizontal direction) (Y) and a length in the upward or downward direction (vertical direction) (Z), that are less than form factors of the filter housing 198, respectively. In other words, the projected area of the controller 180*a* in the forward or backward direction (X) on the Y-Z plane is within the projected area of the filter housing 198 in the forward or backward direction (X) on the Y-Z plane. Referring to FIG. 7B, a controller 180*b* according to an embodiment of the disclosure is different from the controller 180*a* illustrated in FIG. 7A in that an indication unit 182*b* has a circular shape.

At least one of the form factors of the controller 180 may be greater than that of the filter housing 198. The form factors of the filter housing 198 refer to parameters that determine the shape and size of the projected area of the filter housing 198 in the direction of attachment or detachment thereof. Similarly, the form factors of the controller 180 refer to parameters that determine the shape and size of the projected area of the controller 180 in the direction of attachment or detachment of the filter housing 198. For example, in a case in which the appearance of the filter housing 198 has a cylindrical shape, the diameter of the largest cross-section of the filter housing 198 on the Y-Z plane is the form factor of the filter housing 198. The controller 180 may include the longest lengths of the controller 180 in the lateral direction (Y) and the upward or downward direction (Z).

Figure 7C:
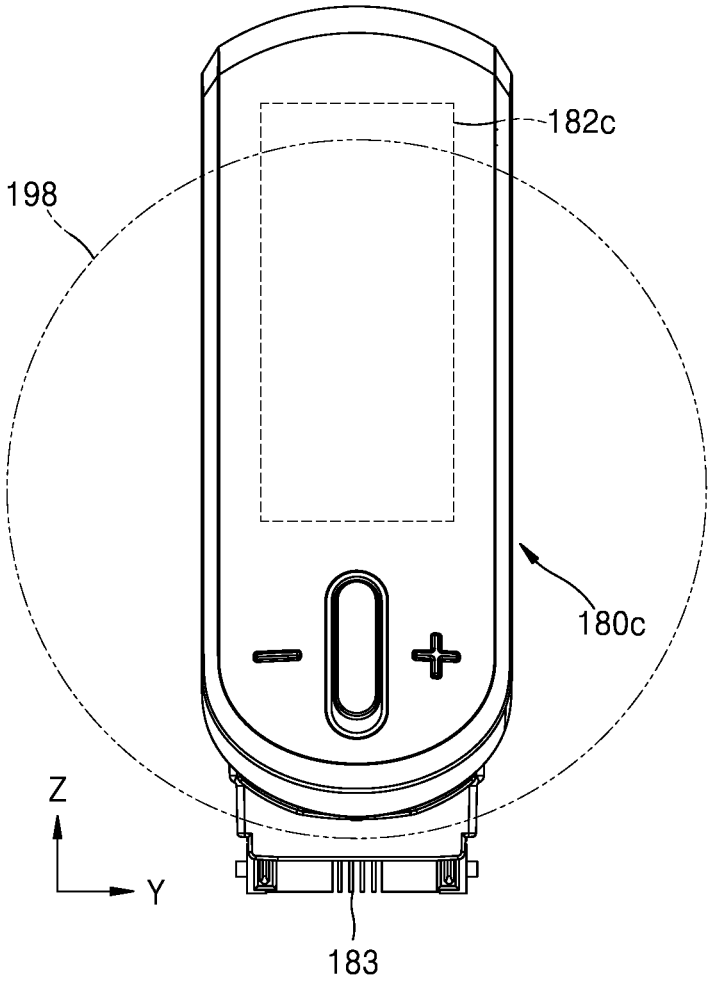

Referring to FIG. 7C, a controller 180*c* according to an embodiment of the disclosure includes a indication unit 182*c* that is longer in the upward or downward direction (Z) than the indication unit 182*a* of the controller 180*a* illustrated in FIG. 7A. The length of the controller 180*c* in the upward or downward direction (Z) is greater than the diameter of the filter housing 198. The controller 180*c* extends upward beyond the periphery of the filter housing 198. That is, the projected area of the controller 180*c* on the Y-Z plane exceeds, in the upward or downward direction (Z), the projected area of the filter housing 198 on the Y-Z plane.

Figure 7D:
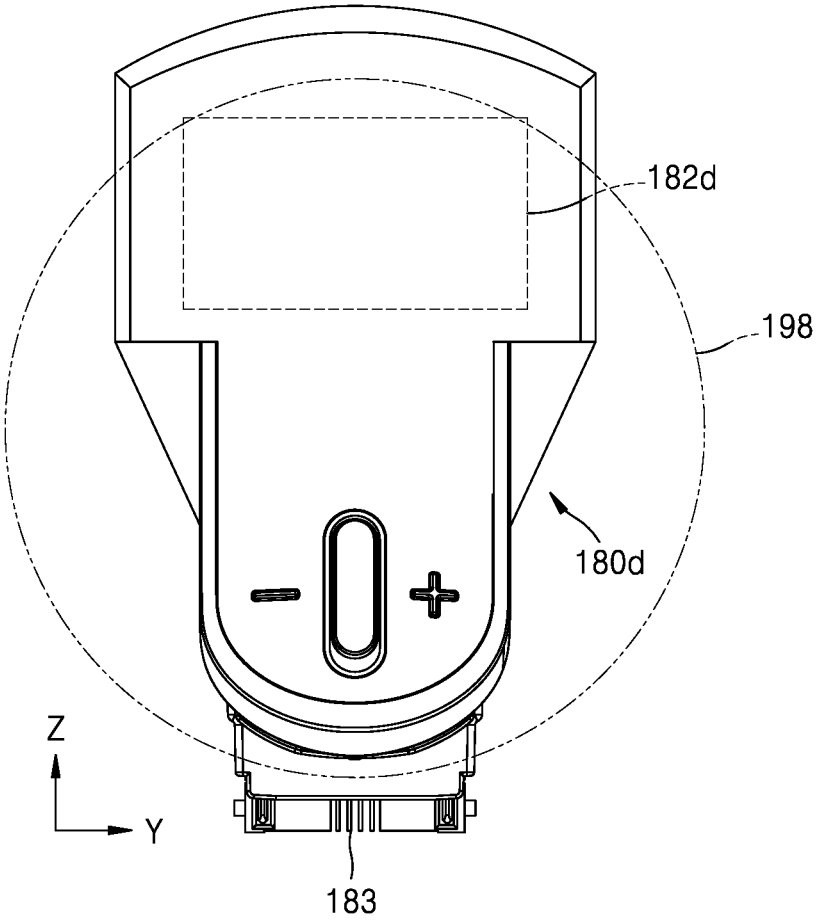

Referring to FIG. 7D, a controller 180*d* according to an embodiment of the disclosure includes an indication unit 182*d* that is longer in the lateral direction (Y) than the indication unit 182*a* of the controller 180*a* illustrated in FIG. 7A. The length of the controller 180*d* in the lateral direction (Y) is greater than the diameter of the filter housing 198. The controller 180*d* extends in the lateral direction (Y) beyond the periphery of the filter housing 198. That is, the projected area of the controller 180*d* on the Y-Z plane exceeds, in the lateral direction (Y), the projected area of the filter housing 198 on the Y-Z plane.

Figure 7E:
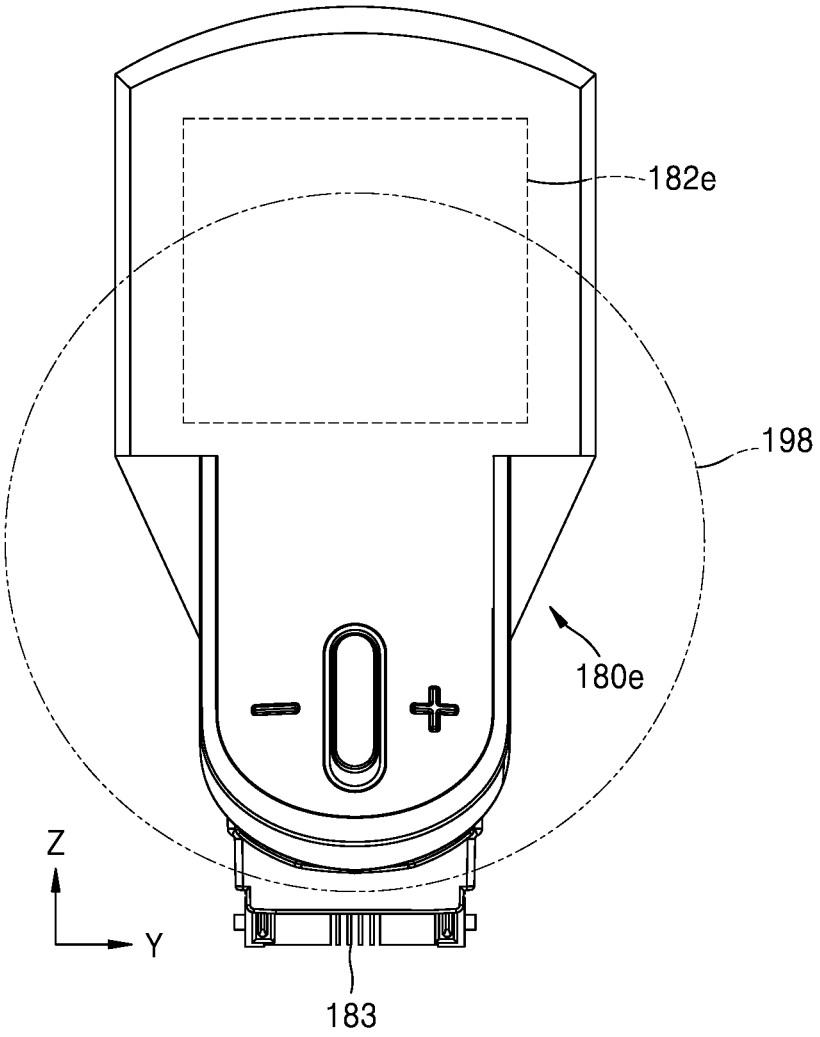

Referring to FIG. 7E, a controller 180*e* according to an embodiment of the disclosure includes an indication unit 182*e* that is longer in both the upward or downward direction (Z) and the lateral direction (Y) than the indication unit 182*a* of the controller 180*a* illustrated in FIG. 7A. The controller 180*e* extends in the upward or downward direction (Z) beyond the periphery of the filter housing 198. The lengths of the controller 180*e* in the upward or downward direction (Z) and the lateral direction (Y) are both greater than the diameter of the filter housing 198. That is, the projected area of the controller 180*e* on the Y-Z plane exceeds, in the upward or downward direction (Z) and the lateral direction (Y), the projected area of the filter housing 198 on the Y-Z plane.

As such, the controller 180 including the indication unit 182 having various sizes and shapes may be mounted on the main body 100 to reflect the user's demand. Although not illustrated in FIGS. 7A to 7E, various controllers 180 having various exterior colors and including manipulation units 181 having different colors and shapes may be provided, and an appropriate controller 180 may be mounted on the main body 100 according to the user's preferences.

Another controller 180 having various functions reflecting the user's usage patterns may be mounted on the main body 100 to replace the existing controller 180. For example, a standard controller capable of selecting a normal mode, a strong-suction mode, and a super-strong-suction mode, a professional controller capable of selecting the normal mode, an eco mode, the strong-suction mode, the super-strong-suction mode, and a jet mode, or a senior-type controller capable of selecting the normal mode and the super-strong-suction mode, and displaying information in a large size. For example, the standard controller and the professional controller may have the shapes illustrated in FIGS. 7A to 7E. For example, the senior-type controller may have a shape for displaying large letters, as illustrated in FIGS. 7D and 7E.

Figure 8:
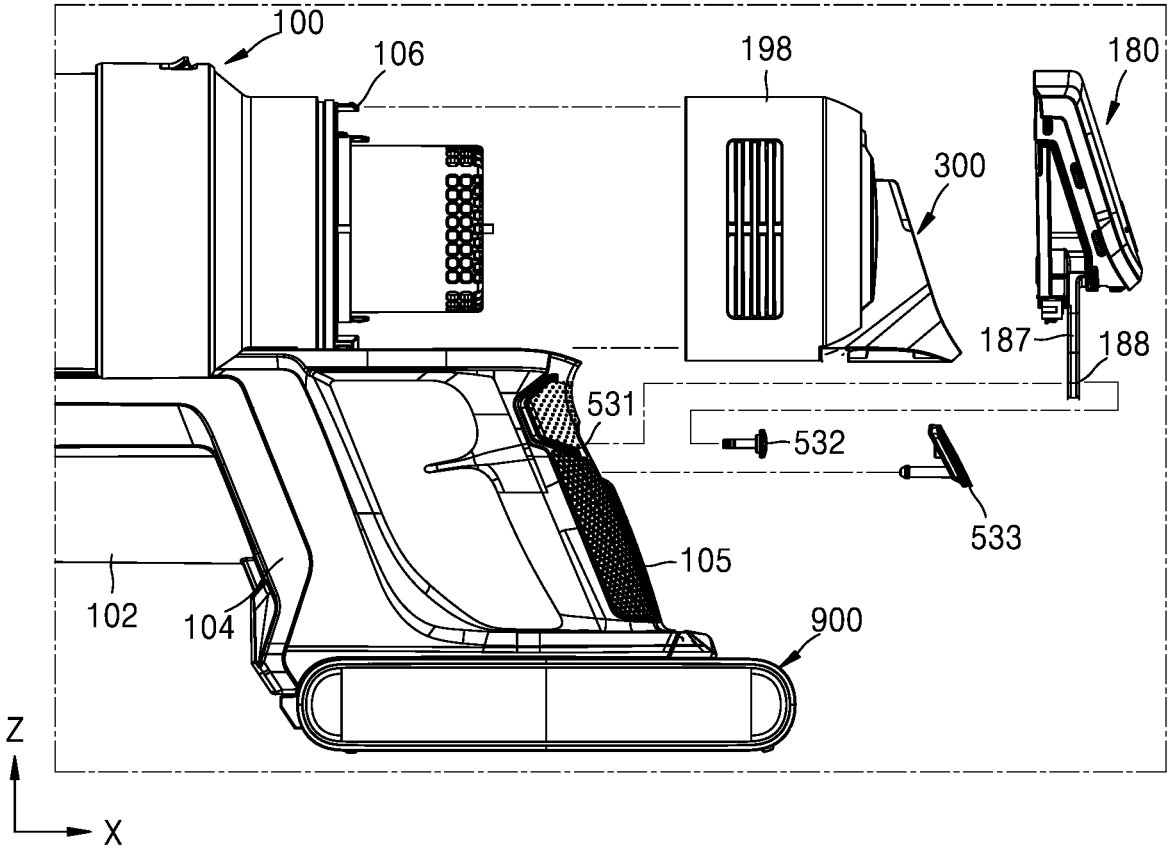
FIG. 8 is a schematic side view illustrating a state in which a filter housing is separated from a main body.

As described above, the cleaner of the disclosure includes the filter housing 198 that may be separated from the cleaner in the backward direction. The detachable controller 180 enables the separation of the filter housing 198 from the cleaner in the backward direction. FIG. 8 is a schematic side view illustrating a state in which the filter housing 198 is separated from the main body 100. Referring to FIG. 8, because the controller 180 is arranged at the rear of the filter housing 198, the controller 180 is first separated from the main body 100 before separating the filter housing 198 from the main body 100. For example, the cover 533 is removed from the handle 105 to expose the screw fastening hole 531. The fixation of the controller 180 is released by loosening the screw 532. Then, the controller 180 is separated from the socket 300 by sliding the controller 180 upward. Then, the filter housing 198 may be separated from the main body 100 by sliding the filter housing 198 backward. The socket 300 is separated from the main body 100 integrally with the filter housing 198.

After replacing or cleaning the filter 197, the filter housing 198 may be mounted on the main body 100. The filter housing 198 may be fixed to the main body 100, for example, by being hooked on a hook 106 provided on the main body 100. Then, the controller 180 is inserted into the socket 300 by aligning the controller 180 with the accommodation unit 310 of the socket 300 and then sliding the controller 180 downward. When the controller 180 is completely inserted into the socket 300, the first connector 183 is coupled to the second connector 410 of the main body 100. The locking unit 187 is inserted into the handle 105, and the locking hole 188 is aligned with the screw fastening hole 531. The controller 180 may be fixed to the main body 100 by fastening the screw 532 into the screw fastening hole 531 through the locking hole 188. The screw fastening hole 531 may be covered by coupling the cover 533 to the handle 105.

According to a general cleaner, a filter housing having the shape of a hollow cylinder is employed. In order to allow the filter housing to be separated from the main body when slid backward, the size of the controller needs to be smaller than the inner diameter of the hollow part of the filter housing. Thus, the size of the indication unit is limited and it is difficult to adopt controllers having various sizes and shapes.

According to the cleaner of the disclosure, the controller 180 may be separated from the main body 100. The filter housing 198 may be separated from the main body 100 by separating the controller 180 from the main body 100 first, and then sliding the filter housing 198 backward. Thus, the backward separation of the filter housing 198 is not limited by the size or shape of the controller 180. According to the cleaner including the filter housing 198 that may be separated from the cleaner in the backward direction according to an embodiment of the disclosure, the filter 197 may be easily replaced such that the cleaner may be easily kept clean and may perform a high-performance cleaning operation. In addition, because the filter 197 may be located relatively close to the outlet of the suction fan 191, the curvature of the exhaust path 196 is relatively low, thus, the flow path resistance is relatively low, and the suction efficiency of the suction fan 191 may be improved. In addition, the efficiency of the battery 900 compared to the power of the suction fan 191 increases, and thus, the use time of the cordless cleaner that requires to be recharged before use may increase. In addition, because controllers 180 having various sizes, shapes, and functions may be used, the user convenience may be improved.

Figure 9:
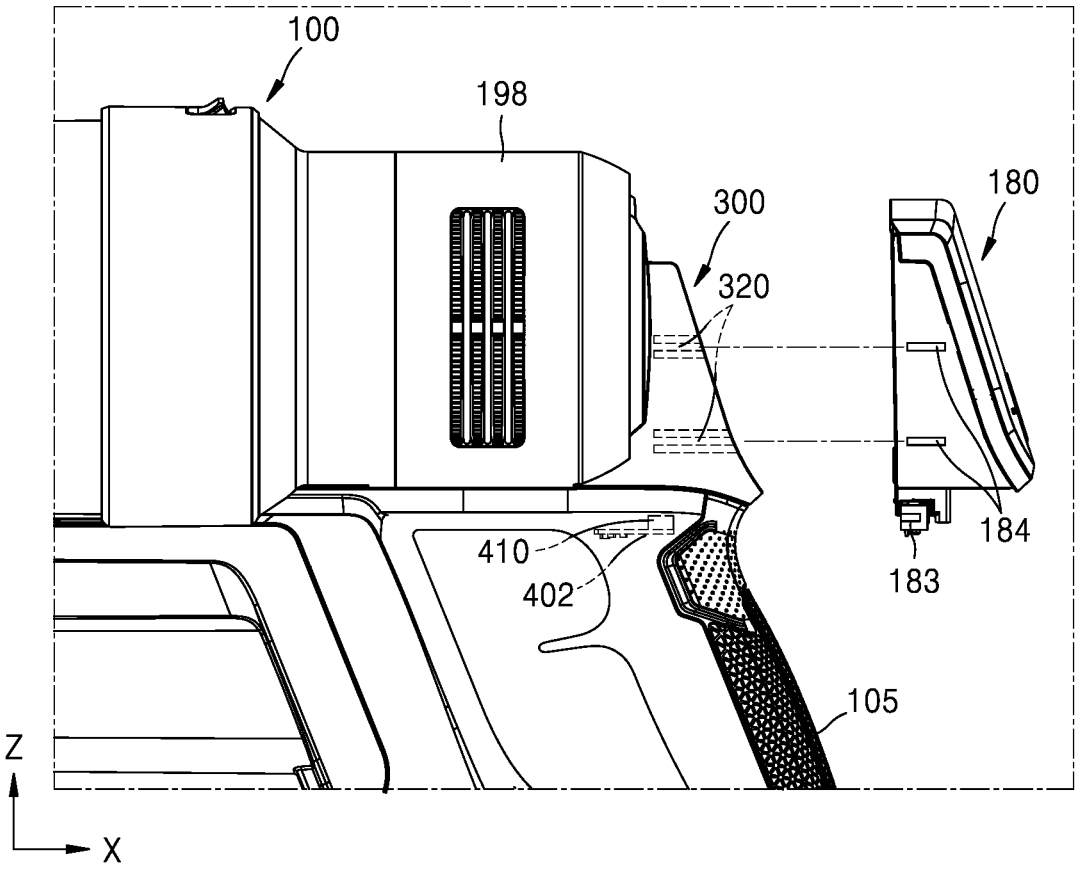
FIG. 9 illustrates a structure in which a controller is attached to or detached from a main body by being slid in a forward or backward direction, according to an embodiment of the disclosure.

In the above-described embodiment of the disclosure, the controller 180 is slid in the upward or downward direction (Z) to be attached to and detached from the main body 100, for example, the socket 300, but the sliding direction of the controller 180 may vary. FIG. 9 illustrates a structure in which the controller 180 is attached to or detached from the main body 100 by being slid in the forward or backward direction (X), according to an embodiment of the disclosure. Referring to FIG. 9, the socket 300 is provided on the rear surface of the filter housing 198. The first guide 320 having a slot shape extending in the forward or backward direction (X) is provided inside the socket 300. The second guide 184 having a protrusion shape extending in the forward or backward direction (X) is provided on the side wall of the controller 180. In order to electrically connect the main body 100 to the controller 180, the first connector 183 is provided in the controller 180. The first connector 183 is provided on the printed circuit board 185 (see FIG. 3) including a control circuit unit. The second connector 410 to engage the first connector 183 is provided in the main body 100. The second connector 410 is provided on the printed circuit board 402 connected to the printed circuit board 401 (see FIG. 3) by the wires 403 (see FIG. 3). The first connector 183 and the second connector 410 may be coupled to each other in the forward or backward direction (X).

The controller 180 is inserted into the accommodation unit 310 of the socket 300 by aligning the second guide 184 with the first guide 320 and moving the controller 180 forward. When the controller 180 is completely inserted into the accommodation unit 310, the first connector 183 engages the second connector 410. Accordingly, the controller 180 may communicate with the battery 900 and the control elements of the main body 100. The controller 180 may be fixed to the main body 100 by various fixing structures. For example, the controller 180 may be fixed to the main body 100 by the above-described snap-fit fixing structure or magnetic fixing structure, or the like. Although not illustrated in the drawings, in the snap-fit fixing structure, the elastic locker 513 (see FIG. 4) may be provided on the side walls 311 forming the accommodation unit 310, and the catching unit 514 (see FIG. 4) may be provided on the sidewalls of the controller 180 opposite to the sidewalls 311. Although not illustrated in the drawings, the magnetic fixing structure may be the same as that illustrated in FIG. 5. Although not illustrated in the drawings, the controller 180 may be fixed to the main body 100 by a screw fastening structure or the like.

Figure 10:
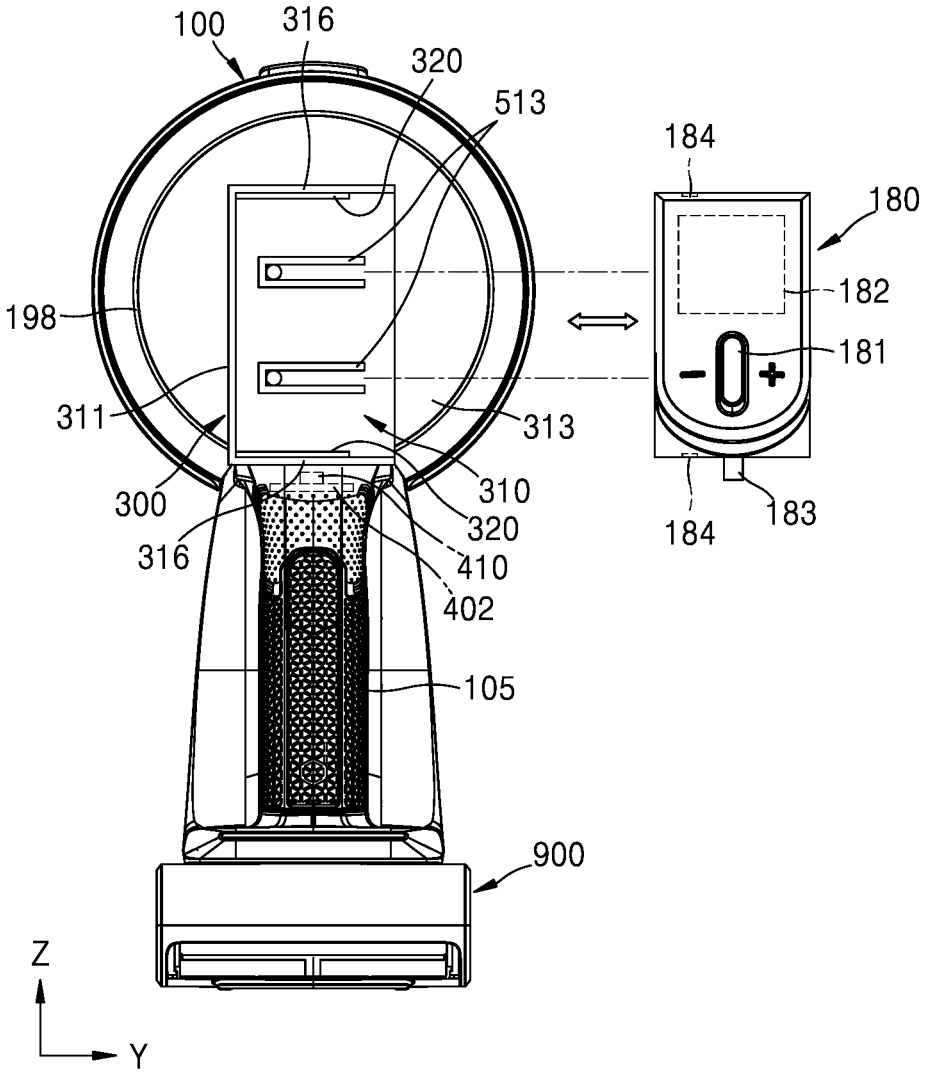
FIG. 10 is a rear view illustrating a structure in which a controller is attached to or detached from a main body by being slid in the lateral direction, according to an embodiment of the disclosure.

FIG. 10 is a rear view illustrating a structure in which the controller 180 is attached to or detached from the main body 100 by being slid in the lateral direction (Y), according to an embodiment of the disclosure. Referring to FIG. 10, the socket 300 is provided on the rear surface of the filter housing 198. The socket 300 includes the accommodation unit 310 opened in the lateral direction (Y). For example, the accommodation unit 310 may be defined by a pair of walls 316 arranged in the upward or downward direction (Z), the side walls 311 connecting one ends of the pair of walls 316 in the lateral direction (Y) to each other, and the front wall 313. The first guide 320 having a slot shape extending in the lateral direction (Y) may be provided inside the pair of walls 316. The second guide 184 having a protrusion shape may be provided on the upper wall and the lower wall of the controller 180. In order to electrically connect the main body 100 to the controller 180, the first connector 183 is provided in the controller 180. The first connector 183 is provided on the printed circuit board 185 (see FIG. 3) including a control circuit unit. The second connector 410 to engage the first connector 183 is provided in the main body 100. The second connector 410 is provided on the printed circuit board 402 connected to the printed circuit board 401 (see FIG. 3) by the wires 403 (see FIG. 3). The first connector 183 and the second connector 410 may be coupled to each other in the lateral direction (Y).

The controller 180 is inserted into the accommodation unit 310 of the socket 300 by aligning the second guide 184 with the first guide 320 and moving the controller 180 in the lateral direction (Y). When the controller 180 is completely inserted into the accommodation unit 310, the first connector 183 engages the second connector 410. Accordingly, the controller 180 may communicate with the battery 900 and the control elements of the main body 100. The controller 180 may be fixed to the main body 100 by various fixing structures. For example, the controller 180 may be fixed to the main body 100 by the above-described snap-fit fixing structure or magnetic fixing structure, or the like. In the snap-fit fixing structure, the elastic locker 513 may be provided on the front wall 313 forming the accommodation unit 310, and the catching unit 514 (see FIG. 4) may be provided on the front wall 186 (see FIG. 4) of the controller 180 opposite to the front wall 313. Although not illustrated in the drawings, the magnetic fixing structure may be the same as that illustrated in FIG. 5. Although not illustrated in the drawings, the controller 180 may be fixed to the main body 100 by a screw fastening structure or the like.

FIG. 10 illustrates a structure according to an embodiment of the disclosure in which the controller 180 is attached to and detached from the main body 100 by being slid in the left direction (−Y) and the right direction (+Y), respectively, but the disclosure is not limited thereto. For example, the cleaner may be designed in a structure in which the controller 180 is attached to and detached from the main body 100 by being slid in the right direction (+Y) and the left direction (−Y), respectively, in a structure in which the controller 180 is attached to and detached from the main body 100 by being slid in the downward direction (−Z) and the upward direction (+Z), respectively, or in a structure in which the controller 180 is attached to and detached from the main body 100 by being slid in the upward direction (+Z) and the downward direction (−Z), respectively.

Figure 11:
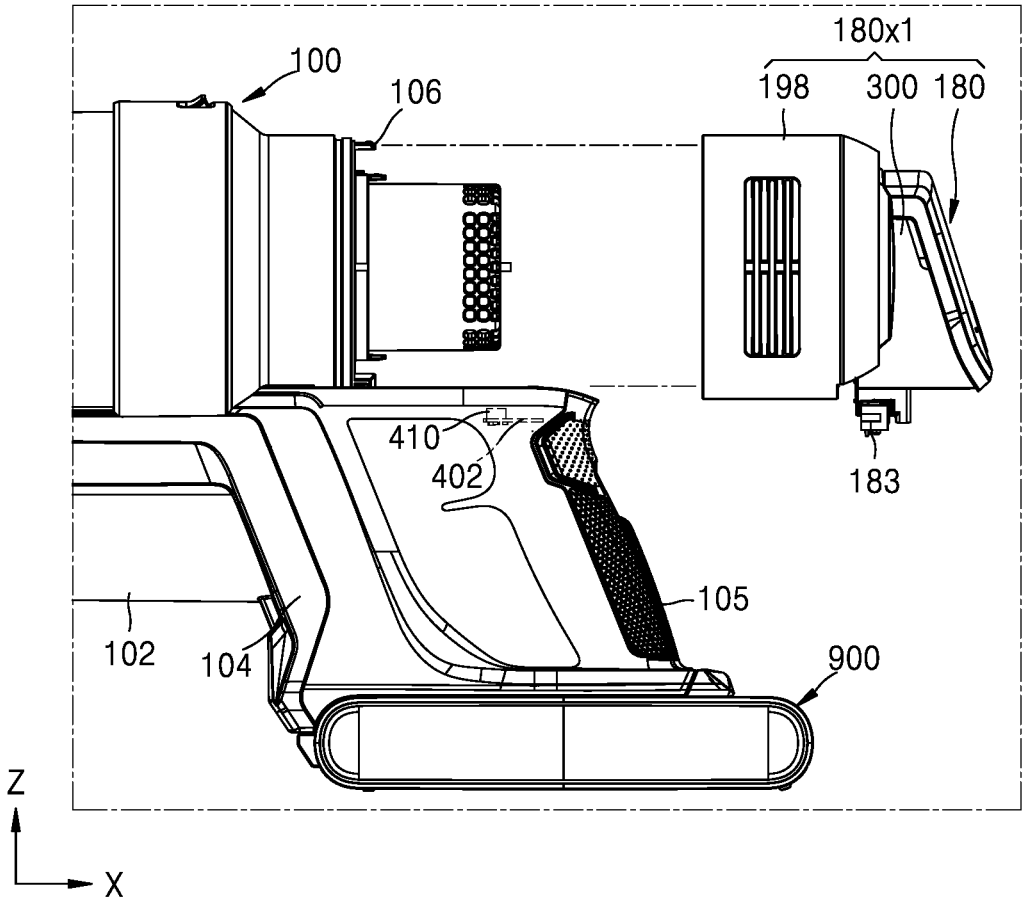
FIG. 11 is a schematic side view of a cleaner according to an embodiment of the disclosure.

The controller 180 may be coupled to the filter housing 198, and thus may be attached to or detached from the main body 100 integrally with the filter housing 198. FIG. 11 is a schematic side view of a cleaner according to an embodiment of the disclosure. Referring to FIG. 11, the socket 300 is provided on the rear surface of the filter housing 198, and the controller 180 is supported by the socket 300. The printed circuit board 402 including the second connector 410 is located in the main body 100, for example, at the rear of the prop 102. The filter housing 198 and the controller 180 integrally form a controller assembly 180X1. The controller assembly 180X1 may be attached to or detached from the main body 100 by being slid in the forward or backward direction (X). The controller 180 may be fixedly supported by the socket 300 and may be attached to and detached from the socket 300 as described above.

When the controller assembly 180X1 is slid forward, the first connector 183 and the second connector 410 are coupled to each other, and the front end of the filter housing 198 is caught on the hook 106 provided in the main body 100. Accordingly, the controller assembly 180X1 may be fixed to the main body 100. The controller assembly 180X1 may be fixed to the main body 100 by a fixing unit not illustrated in the drawings. When the controller assembly 180X1 is slid backward, the front end of the filter housing 198 is separated from the hook 106 and the first connector 183 is separated from the second connector 410. Accordingly, the controller assembly 180X1 may be separated from the main body 100. In this state, maintenance of the filter 197, such as replacement or cleaning, may be performed. In a case in which the controller 180 is detachable from the socket 300, another controller 180 may be mounted on the socket 300 to replace the existing controller 180. In a case in which the controller 180 is fixedly supported by the socket 300, another controller assembly 180X1 to which another controller 180 is applied may be mounted on the main body 100 to replace the existing controller assembly 180X1.

Figure 12:
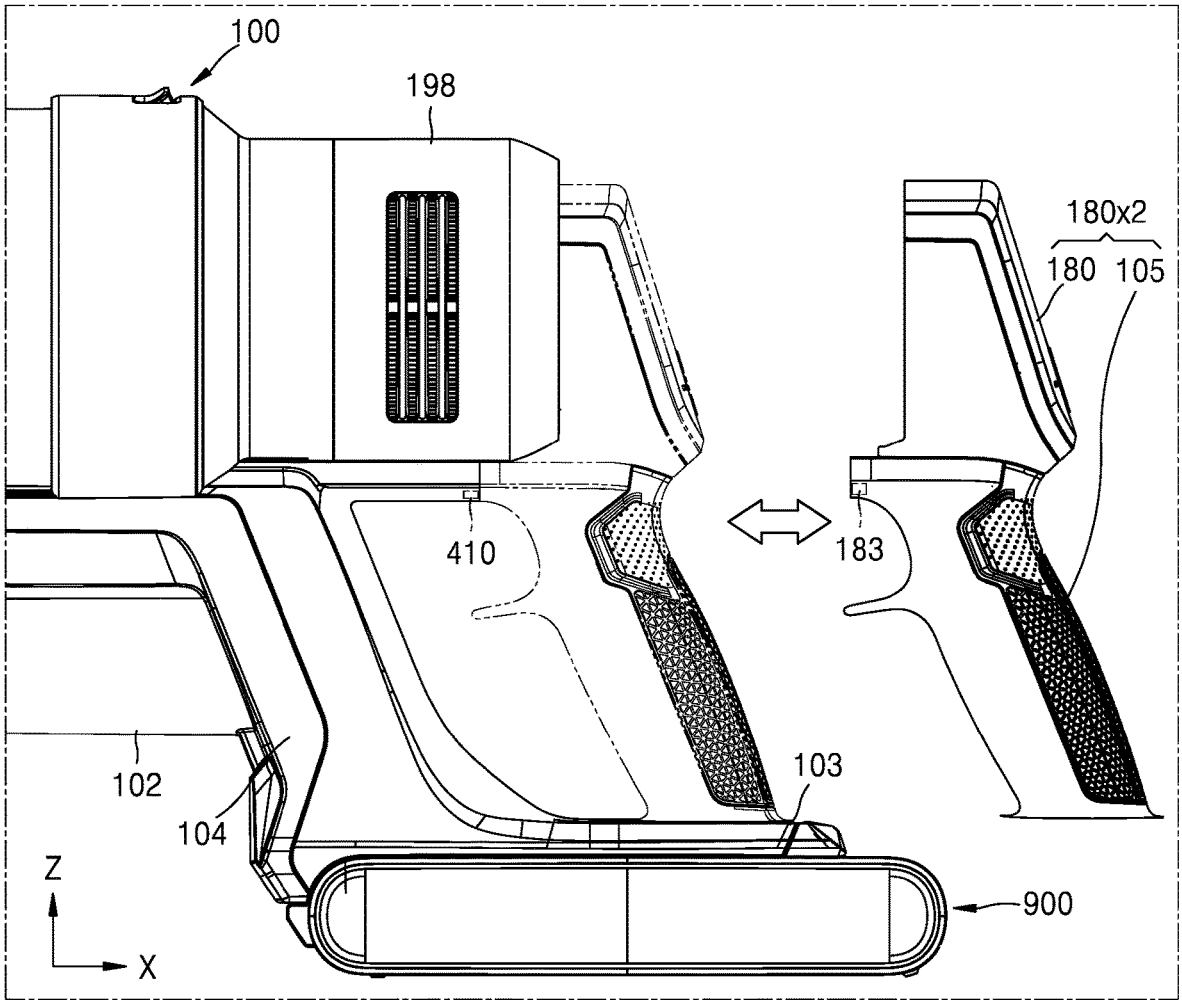
FIG. 12 is a schematic side view of a cleaner according to an embodiment of the disclosure.

The controller 180 may be coupled to the handle 105 and thus may be attached to and detached from the main body 100 integrally with the handle 105. FIG. 12 is a schematic side view of a cleaner according to an embodiment of the disclosure. Referring to FIG. 12, the controller 180 is supported by the upper end of the handle 105. Although not illustrated in the drawings, the socket 300 may be provided at the upper end of the handle 105 and the controller 180 may be detachably supported by the socket 300. The second connector 410 is provided in the main body 100, for example, at the rear of the prop 102. Although not illustrated in the drawings, the second connector 410 is provided on the printed circuit board 402 (see FIG. 3). The handle 105 and the controller 180 integrally form a controller assembly 180X2. The controller assembly 180X2 may be attached to or detached from the main body 100 by being slid in the forward or backward direction (X).

When the controller assembly 180X2 is slid forward, the first connector 183 and the second connector 410 are coupled to each other, and the handle 105 is supported by the main body 100. For example, the upper and lower ends of the handle 105 are supported by the prop 102 and the battery mount 103, respectively. The controller assembly 180X2 may be fastened to the prop 102 and/or the battery mount 103 by a screw (not shown) or the like. Accordingly, the controller assembly 180X2 may be fixed to the main body 100.

By loosening the screw (not shown) and sliding the controller assembly 180X2 backward, the upper and lower ends of the handle 105 are separated from the prop 102 and the battery mount 103, respectively, and the first connector 183 is separated from the second connector 410. Accordingly, the controller assembly 180X2 may be separated from the main body 100. In a case in which the controller 180 is detachable from the socket 300, another controller 180 may be mounted on the socket 300 to replace the existing controller 180. In a case in which the controller 180 is fixedly supported by the socket 300, another controller assembly 180X2 to which another controller 180 is applied may be mounted on the main body 100 to replace the existing controller assembly 180X2. When the filter 197 requires maintenance such as replacement or cleaning, the filter housing 198 may be separated from the main body 100 after the controller assembly 180X2 is separated from the main body 100.

Figure 13:
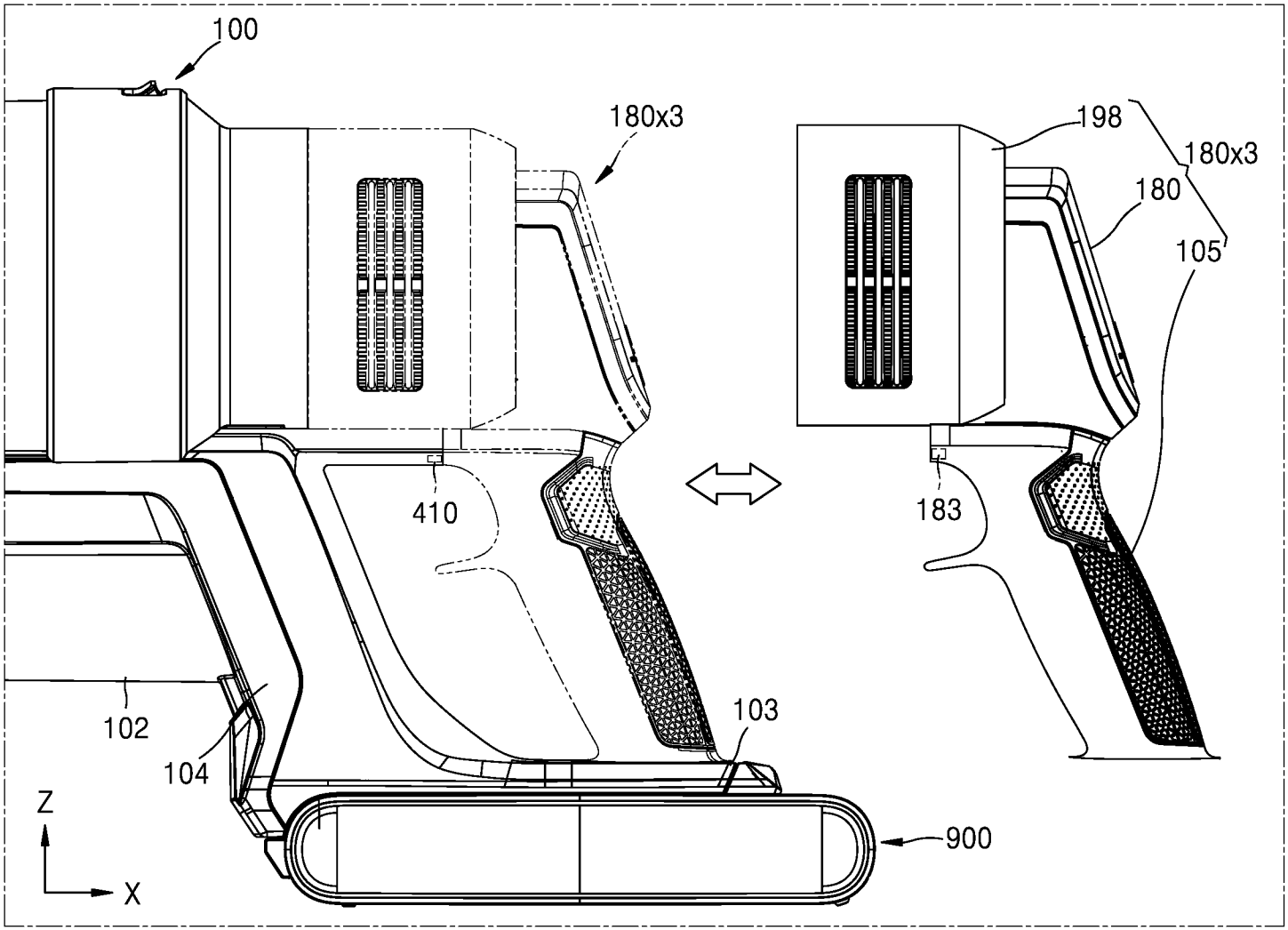
FIG. 13 is a schematic side view of a cleaner according to an embodiment of the disclosure.

The controller 180 may be attached to or detached from the main body 100 integrally with the filter housing 198 and the handle 105. FIG. 13 is a schematic side view of a cleaner according to an embodiment of the disclosure. Referring to FIG. 13, the filter housing 198 and the controller 180 are supported by the upper end of the handle 105. The controller 180 is located at the rear of the filter housing 198. Although not illustrated in the drawings, the socket 300 may be provided at the upper end of the handle 105, i.e., at the rear of the filter housing 198, and the controller 180 may be detachably supported by the socket 300. The second connector 410 is provided in the main body 100, for example, at the rear of the prop 102. Although not illustrated in the drawings, the second connector 410 is located on the printed circuit board 402 (see FIG. 3). The handle 105, the filter housing 198, and the controller 180 integrally form a controller assembly 180X3. The controller assembly 180X3 may be attached to or detached from the main body 100 by being slid in the forward or backward direction (X).

When the controller assembly 180X3 is slid forward, the first connector 183 and the second connector 410 are coupled to each other, and the upper and lower ends of the handle 105 are supported by the prop 102 and the battery mount 103, respectively. The front end of the filter housing 198 may be hooked on the hook 106 (see FIG. 8). The controller assembly 180X3 may be fastened to the prop 102 or the battery mount 103 by a screw (not shown) or the like. Accordingly, the controller assembly 180X3 may be fixed to the main body 100.

By loosening the screw (not shown) and sliding the controller assembly 180X3 backward, the front end of the filter housing 198 is released from the hook 106 (see FIG. 8), and the upper and lower ends of the handle 105 are separated from the prop 102 and the battery mount 103, respectively. The first connector 183 is separated from the second connector 410. Accordingly, the controller assembly 180X3 may be separated from the main body 100. In a case in which the controller 180 is detachable from the socket 300, another controller 180 may be mounted on the socket 300 to replace the existing controller 180. In a case in which the controller 180 is fixedly supported by the socket 300, another controller assembly 180X3 to which another controller 180 is applied may be mounted on the main body 100 to replace the existing controller assembly 180X3. When necessary, maintenance of the filter 197, such as replacement or cleaning, may be performed.

To enable the backward separation of the filter housing 198, the controller 180 may be switched to a retreat position not to interfere with the filter housing 198 when the filter housing 198 is detached from the cleaner in the backward direction. In other words, the controller 180 may be switched between a use position at the rear of the filter housing 198, and the retreat position described above.

Figure 14:
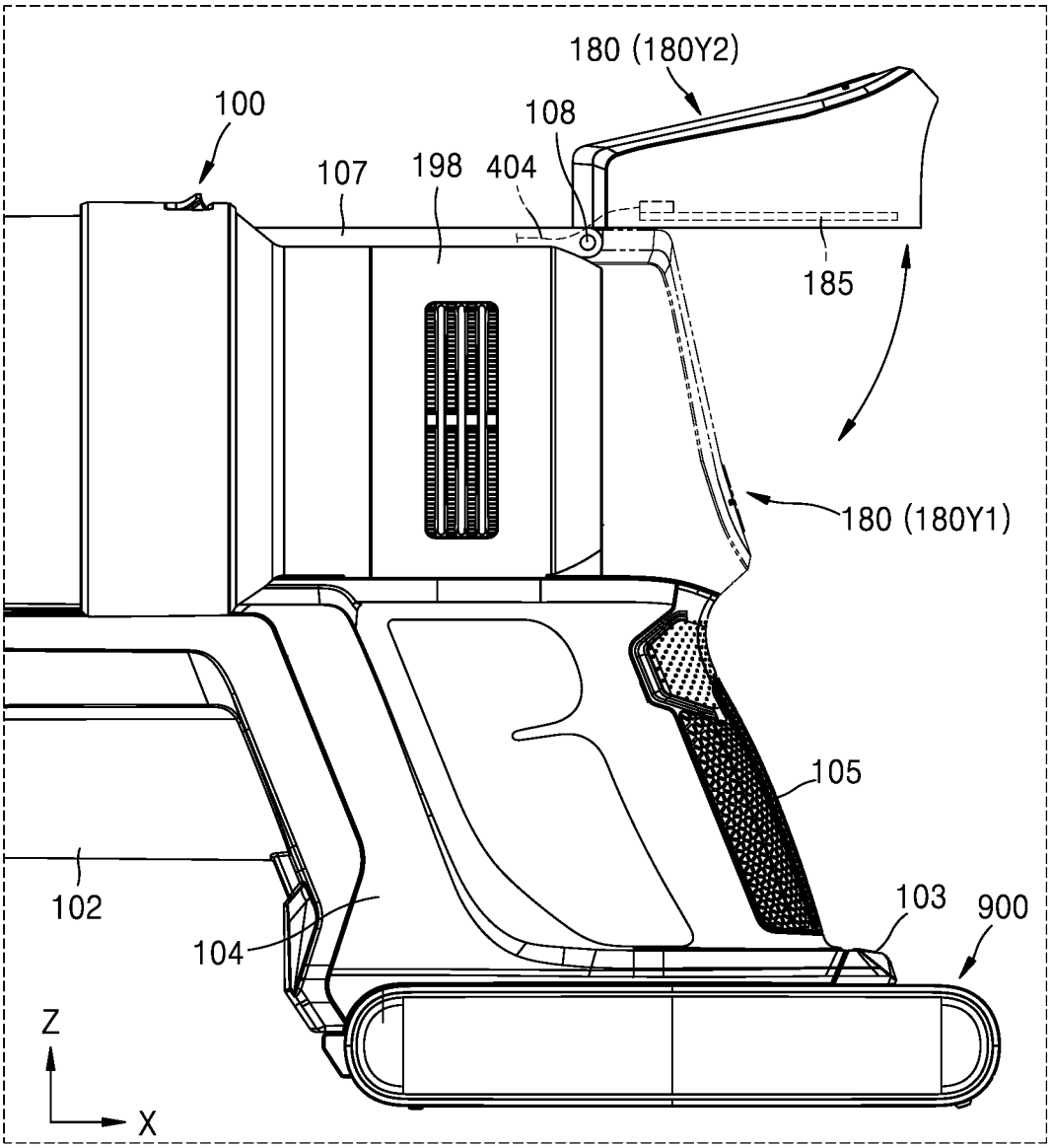
FIG. 14 is a schematic side view of a cleaner according to an embodiment of the disclosure.

FIG. 14 is a schematic side view of a cleaner according to an embodiment of the disclosure. Referring to FIG. 14, the controller 180 may be rotated to a use position 180Y1 at the rear of the filter housing 198, and a retreat position 180Y2 in which the controller 180 does not interfere with the filter housing 198 being detached from the cleaner in the backward direction. The main body 100 may include an upper support 107. The upper support 107 may be located above the filter housing 198 and may extend rearward while surrounding the perimeter of the dust collector 192. The upper support 107 may extend from the prop 102. The upper support 107 may partially surround the filter housing 198. The upper support 107 may entirely surround the filter housing 198. In this case, the rear end of the upper support 107 may be open. The controller 180 is rotatably supported by a hinge 108 at the rear end of the upper support 107. The hinge 108 includes a shaft in the lateral direction (Y). The printed circuit board 185 of the controller 180 may be electrically connected to the above-described printed circuit board 401 (see FIG. 3) by, for example, a flexible wire 404. Although not illustrated in the drawings, the cleaner may have a fixing structure for fixing the controller 180 to the use position 180Y1. The fixing structure may include, for example, a snap-fit fixing structure, a magnetic fixing structure, a screw fastening structure, and the like.

When the cleaner is in use, the controller 180 is at the use position 180Y1 as illustrated by dotted lines in FIG. 14. At the use position 180Y1, the controller 180 is located at the rear of the filter housing 198 and above the handle 105. Before separating the filter housing 198 from the main body 100, the controller 180 is rotated upward about the hinge 108 to be at the retreat position 180Y2. At the retreat position 180Y2, the controller 180 does not interfere with the filter housing 198 being slid backward from the main body 100. The filter housing 198 may be separated from the main body 100 while the controller 180 is at the retreat position 180Y2.

Figure 15:
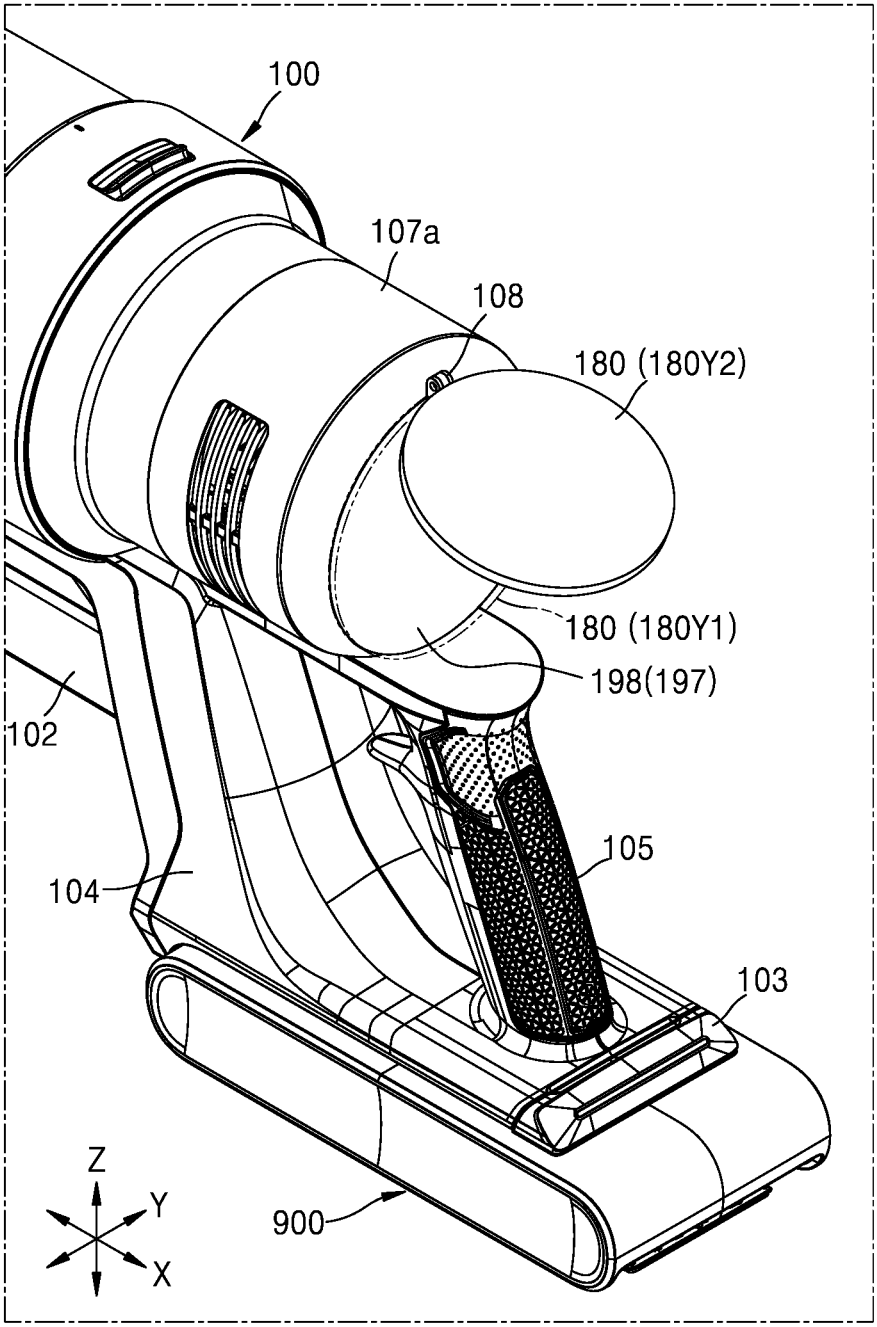
FIG. 15 is a schematic perspective view of a cleaner according to an embodiment of the disclosure.

FIG. 15 is a schematic perspective view of a cleaner according to an embodiment of the disclosure. The cleaner according to the present embodiment of the disclosure is different from the cleaner according to the embodiment of the disclosure illustrated in FIG. 14 in that an upper support **107*a* entirely surrounds the filter housing 198. Hereinafter, differences from the embodiment of the disclosure illustrated in FIG. 14 will be mainly described, and redundant descriptions will be omitted. Referring to FIG. 15, the upper support 107*a* entirely surrounds the filter housing 198. The upper support 107*a* may have a cylindrical shape with an open rear end. The filter housing 198 is located inside the upper support 107*a*. The controller 180 is supported by the hinge 108 at the rear end of the upper support 107*a* such that the controller 180 may be rotated to the use position 180Y1 at the rear of the filter housing 198, and the retreat position 180Y2 in which the controller 180 does not interfere with the filter housing 198 being detached from the cleaner in the backward direction. The printed circuit board 185 (see FIG. 14) of the controller 180 may be electrically connected to the above-described printed circuit board 401 (see FIG. 3) by, for example, the flexible wire 404**.

When the cleaner is in use, the controller 180 is at the use position 180Y1 as illustrated by dotted lines in FIG. 15. At the use position 180Y1, the controller 180 blocks the open end of the upper support **107*a*. The controller 180 is located at the rear of the filter housing 198 and above the handle 105. Before separating the filter housing 198 from the main body 100, the controller 180 is rotated upward about the hinge 108 to be at the retreat position 180Y2. In this state, the filter housing 198 may be separated from the main body 100**.

The upper support **107*a* may be the filter housing 198. In this case, the filter housing 198 has a cylindrical shape with an open rear end. The controller 180 is supported by the hinge 108 at the rear end of the filter housing 198 to be able to be rotated to the use position 180Y1 and the retreat position 180Y2. When the controller 180 is at the use position 180Y1, the rear end of the filter housing 198 is blocked by the controller 180. When the controller 180 is at the retreat position 180Y2, the rear end of the filter housing 198 is opened, and in this state, the filter 197 may be separated from the filter housing 198 and a new filter 197 may be mounted in the filter housing 198. Of course, after washing the filter 197, the filter 197 may be mounted again in the filter housing 198**.

Figure 16:
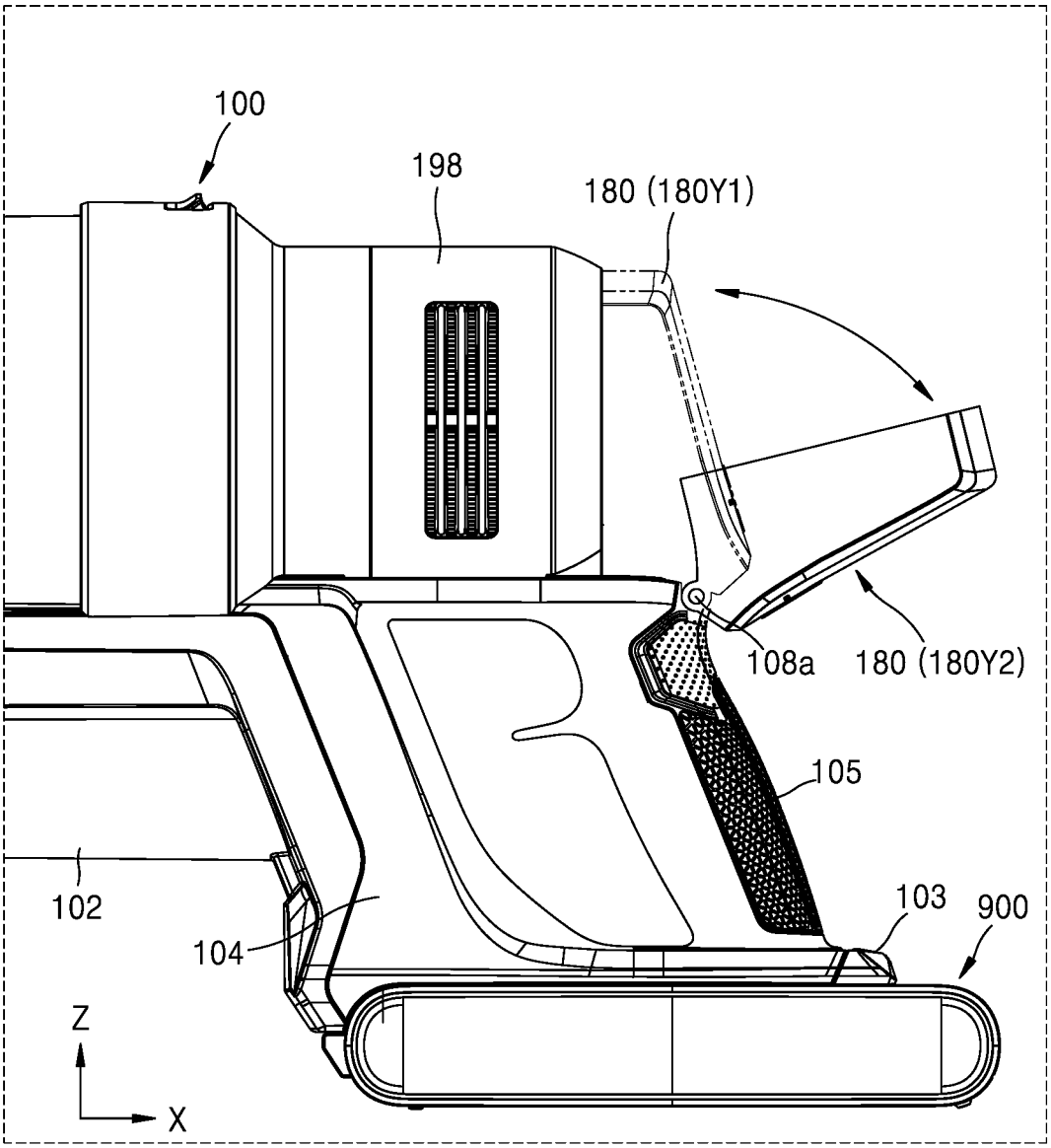
FIG. 16 is a schematic side view of a cleaner according to an embodiment of the disclosure.

FIG. 16 is a schematic side view of a cleaner according to an embodiment of the disclosure. The cleaner according to the present embodiment of the disclosure is different from the above-described cleaner according to the embodiment of the disclosure illustrated in FIG. 14 in that the controller 180 is rotatably supported at the upper end of the handle 105. Referring to FIG. 16, the controller 180 is supported by the main body 100, for example, by the handle 105, such that the controller 180 may be rotated to the use position 180Y1 at the rear of the filter housing 198, and the retreat position 180Y2 in which the controller 180 does not interfere with the filter housing 198 being detached from the cleaner in the backward direction. The controller 180 is rotatably supported by a hinge **108*a* at the upper end of the handle 105. The hinge 108*a* includes a shaft in the lateral direction (Y). The printed circuit board 185 (see FIG. 14) of the controller 180 may be electrically connected to the above-described printed circuit board 401 (see FIG. 3) by, for example, the flexible wire 404 (see FIG. 14**).

When the cleaner is in use, the controller 180 is at the use position 180Y1 as illustrated by dotted lines in FIG. 16. At the use position 180Y1, the controller 180 is located at the rear of the filter housing 198 and above the handle 105. Before separating the filter housing 198 from the main body 100, the controller 180 is rotated downward about the hinge 108*a* to be at the retreat position 180Y2. At the retreat position 180Y2, the controller 180 does not interfere with the filter housing 198 being slid backward from the main body 100. The filter housing 198 may be separated from the main body 100 while the controller 180 is at the retreat position 180Y2.

Figure 17:
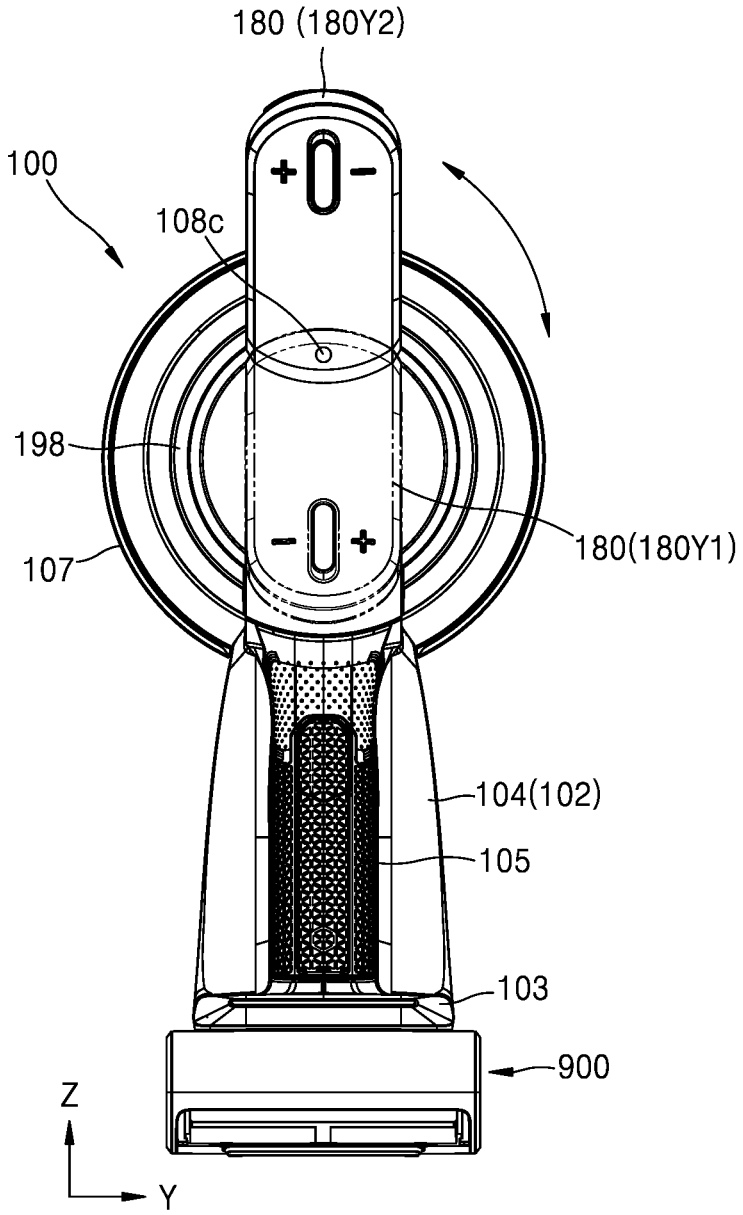
FIG. 17 is a schematic rear view of a cleaner according to an embodiment of the disclosure.

FIG. 17 is a schematic rear view of a cleaner according to an embodiment of the disclosure. The cleaner according to the present embodiment of the disclosure is different from the cleaner according to the embodiment of the disclosure illustrated in FIG. 14 in that a hinge 108*c* including a shaft in the forward or backward direction (X) is employed. Hereinafter, differences between the two cleaners will be mainly described. Referring to FIG. 17, the controller 180 may be rotated to the use position 180Y1 at the rear of the filter housing 198, and the retreat position 180Y2 in which the controller 180 does not interfere with the filter housing 198 being detached from the cleaner in the backward direction. The controller 180 is rotatably supported by the hinge 108*c* at the rear end of the upper support 107. The hinge 108*c* includes the shaft in the forward or backward direction (X). The printed circuit board 185 of the controller 180 may be electrically connected to the above-described printed circuit board 401 (see FIG. 3) by, for example, the flexible wire 404. Although not illustrated in the drawings, the cleaner may have a fixing structure for fixing the controller 180 to the use position 180Y1. The fixing structure may include, for example, a snap-fit fixing structure, a magnetic fixing structure, a screw fastening structure, and the like.

When the cleaner is in use, the controller 180 is at the use position 180Y1 as illustrated by dotted lines in FIG. 17. At the use position 180Y1, the controller 180 is located at the rear of the filter housing 198 and above the handle 105. Before separating the filter housing 198 from the main body 100, the controller 180 is rotated upward about the hinge 108*c* to be at the retreat position 180Y2. At the retreat position 180Y2, the controller 180 does not interfere with the filter housing 198 being slid backward from the main body 100. The filter housing 198 may be separated from the main body 100 while the controller 180 is at the retreat position 180Y2.

Figure 18:
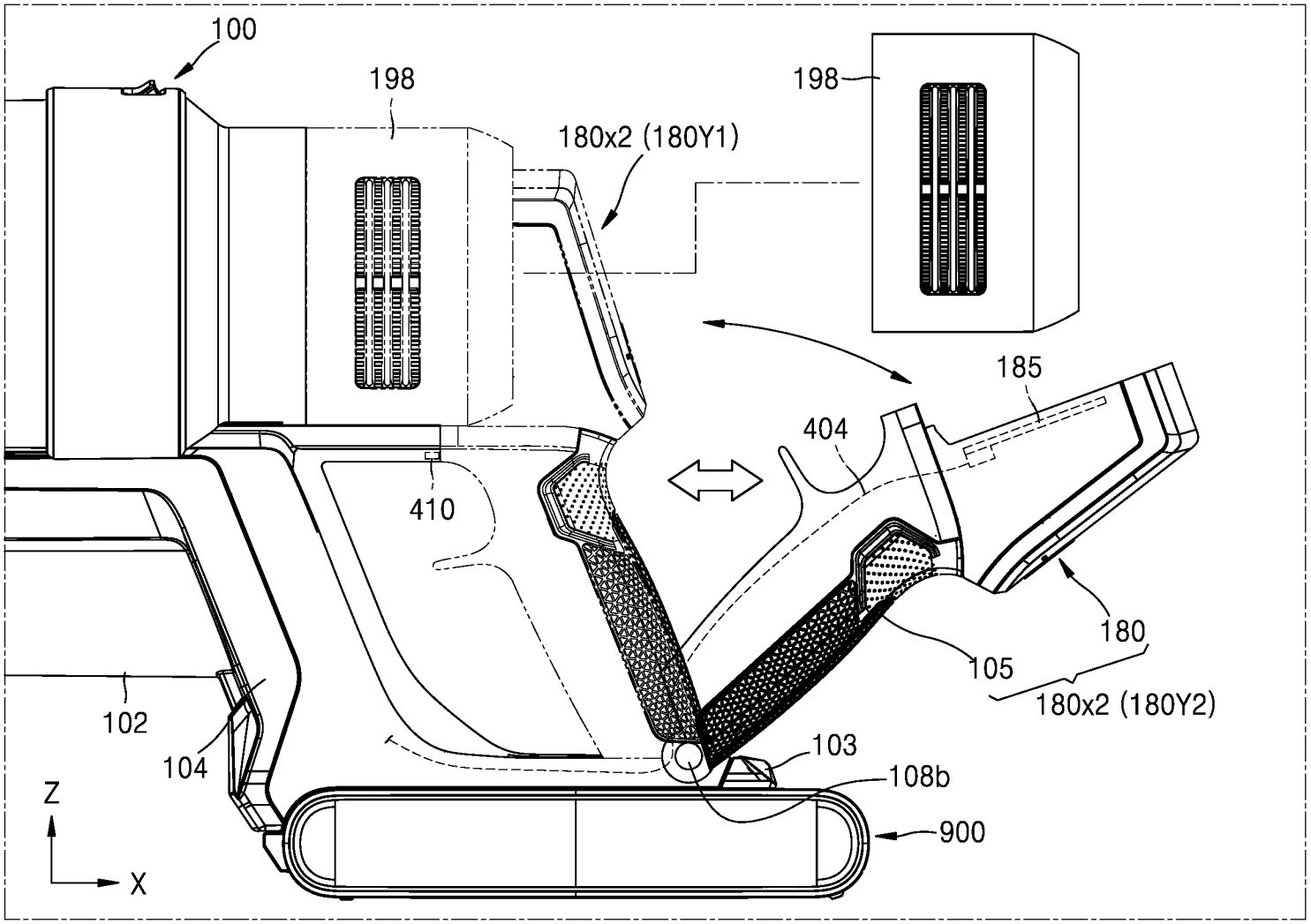
FIG. 18 is a schematic side view of a cleaner according to an embodiment of the disclosure.

The controller 180 may be switched to the use position 180Y1 and the retreat position 180Y2 integrally with the handle 105. FIG. 18 is a schematic side view of a cleaner according to an embodiment of the disclosure. Referring to FIG. 18, the handle 105 and the controller 180 integrally form the controller assembly 180X2. The controller assembly 180X2 is supported by the main body 100 such that the controller 180 may be rotated to the use position 180Y1 at the rear of the filter housing 198, and the retreat position 180Y2 in which the controller 180 does not interfere with the filter housing 198 being detached from the cleaner in the backward direction. For example, the lower end of the handle 105 is rotatably supported by a hinge 108*b* at the battery mount 103. The hinge 108*b* includes a shaft in the lateral direction (Y). The printed circuit board 185 of the controller 180 may be electrically connected to the above-described printed circuit board 401 (see FIG. 3) by, for example, the flexible wire 404, via the hinge 108*b*.

When the cleaner is in use, the controller assembly 180X2 is at the use position 180Y1 as illustrated by dotted lines in FIG. 18. At the use position 180Y1, the controller 180 is located at the rear of the filter housing 198 and above the handle 105. Before separating the filter housing 198 from the main body 100, the controller assembly 180X2 is rotated about the hinge 108*b* to be at the retreat position 180Y2. At the retreat position 180Y2, the controller 180 does not interfere with the filter housing 198 being slid backward from the main body 100. The filter housing 198 may be separated from the main body 100 while the controller 180 is at the retreat position 180Y2.

Figure 19:
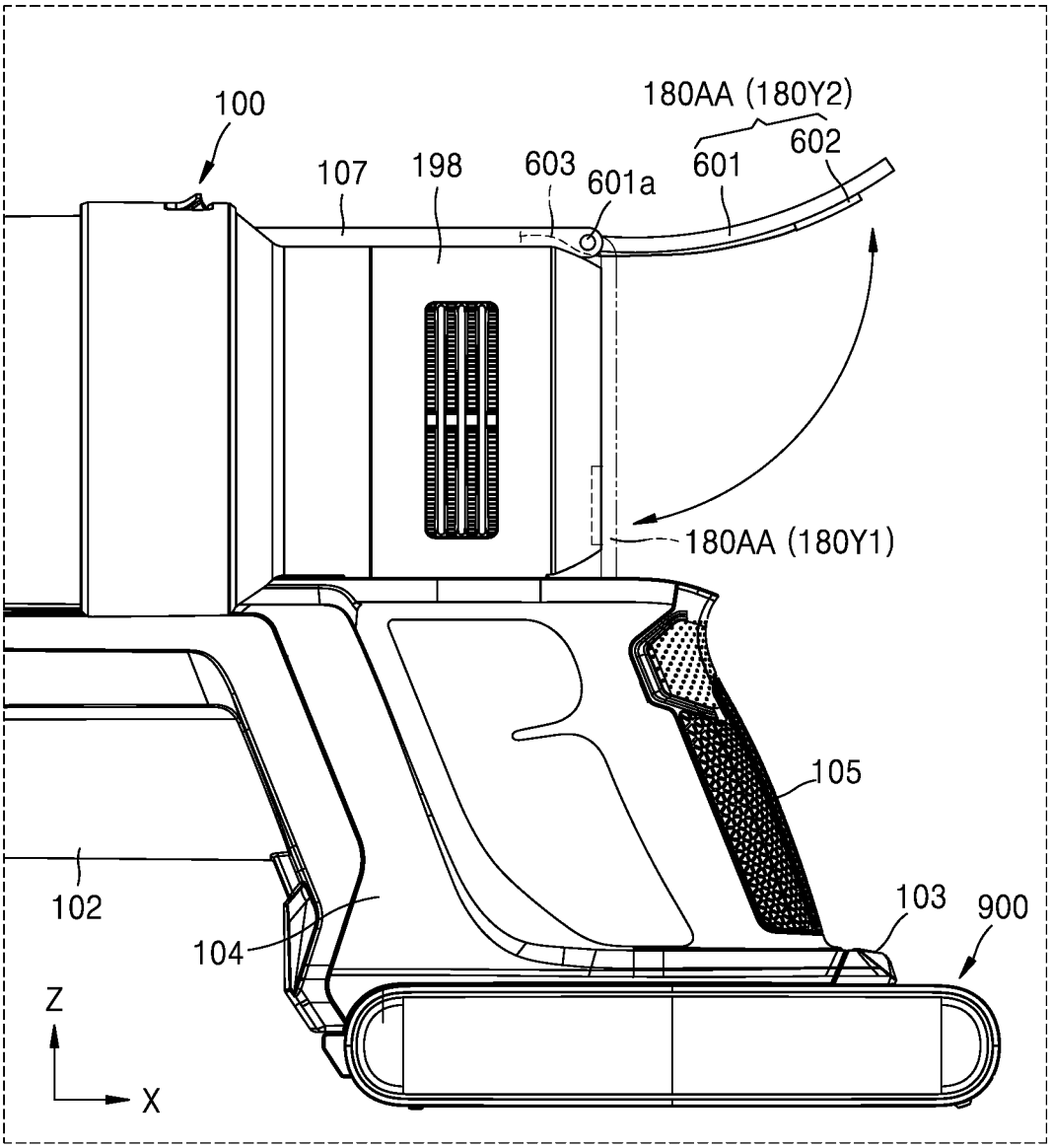
FIG. 19 is a schematic side view of a cleaner according to an embodiment of the disclosure.

To enable the backward separation of the filter housing 198, the controller 180 may have a flexible structure to be able to be bent from the use position to the retreat position. FIG. 19 is a schematic side view of a cleaner according to an embodiment of the disclosure. The cleaner according to the present embodiment of the disclosure is different from the cleaner according to the embodiment of the disclosure illustrated in FIG. 14 in that a flexible controller 180AA is employed. Hereinafter, differences between the two cleaners will be mainly described. Referring to FIG. 19, the controller 180AA may include a flexible window 601 and a flexible display 602 supported by the window 601. The flexible display 602 may be, for example, a touch panel display in which the manipulation unit 181 (see FIG. 1) and the indication unit 182 (see FIG. 1) are integrated. The window 601 may be formed of a light-transmitting material. A flexible circuit board 603 may be provided along an inner surface of the window 601. The display 602 may be arranged on the inner surface of the window 601. The flexible circuit board 603 may be connected to the display 602. One end 601*a* of the window 601 is fixed to the rear end of the upper support 107. The flexible circuit board 603 extends into the main body 100 through the upper support 107, and may be connected to the above-described printed circuit board 401.

When the cleaner is in use, the controller 180AA is at the use position 180Y1 as illustrated by dotted lines in FIG. 19. At the use position 180Y1, the controller 180AA is located at the rear of the filter housing 198 and above the handle 105. Before separating the filter housing 198 from the main body 100, the controller 180AA is switched to the retreat position 180Y2. Because the window 601 is flexible, the window 601 may be bent by using the vicinity of the end 601*a* as a hinge. Accordingly, the controller 180AA may be at the retreat position 180Y2 as illustrated by solid lines in FIG. 19. The filter housing 198 may be separated from the main body 100 while the controller 180AA is at the retreat position 180Y2.

Figure 20:
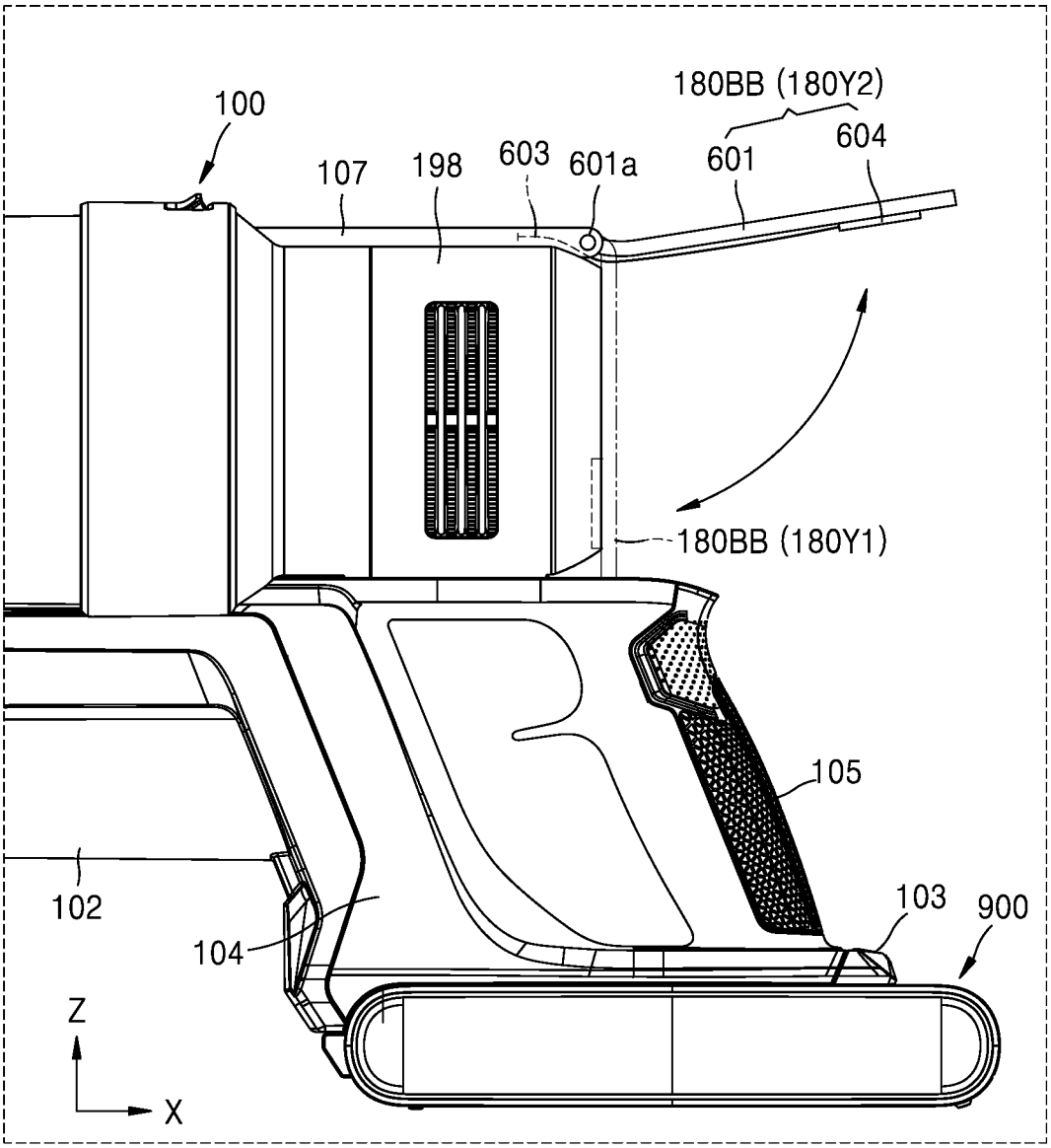
FIG. 20 is a schematic side view of a cleaner according to an embodiment of the disclosure.

FIG. 20 is a schematic side view of a cleaner according to an embodiment of the disclosure. The cleaner according to the present embodiment of the disclosure is different from the cleaner according to the embodiment of the disclosure illustrated in FIG. 19 in that an inflexible display 604 is employed. Hereinafter, differences between the two cleaners will be mainly described. Referring to FIG. 20, a controller 180BB may include the flexible window 601 having light-transmissive properties and the display 604 supported by the window 601. The display 604 is inflexible due to its rigidity. The display 604 may be, for example, a touch panel display in which the manipulation unit 181 (see FIG. 1) and the indication unit 182 (see FIG. 1) are integrated. The flexible circuit board 603 may be provided along an inner surface of the window 601. The display 604 may be arranged on the inner surface of the window 601. The flexible circuit board 603 may be connected to the display 604. One end 601*a* of the window 601 is fixed to the rear end of the upper support 107. The flexible circuit board 603 extends into the main body 100 through the upper support 107, and may be connected to the above-described printed circuit board 401.

When the cleaner is in use, the controller 180BB is at the use position 180Y1 as illustrated by dotted lines in FIG. 20.

At the use position 180Y1, the controller 180BB is located at the rear of the filter housing 198 and above the handle 105. Before separating the filter housing 198 from the main body 100, the controller 180BB is rotated to the retreat position 180Y2. Because the window 601 is flexible, the window 601 may be bent by using the vicinity of the end 601*a* as a hinge. Accordingly, the controller 180BB may be at the retreat position 180Y2 as illustrated by solid lines in FIG. 20. The filter housing 198 may be separated from the main body 100 while the controller 180BB is at the retreat position 180Y2.

In the above-described embodiments of the disclosure, the controller 180 and the main body 100 are communicatively connected to each other by a wired connection structure. The controller 180 and the main body 100 may be communicatively connected to each other through a wireless connection structure. For example, the controller 180 and the main body 100 may be connected to each other through a short-range wireless network. The short-range wireless networks include, for example, Bluetooth™ (Institute of Electrical and Electronics Engineers (IEEE) 802.15.1), Zigbee (IEEE 802.15.4), Wi-Fi Direct, near-field communication (NFC), Z-Wave Wave), etc., but is not limited thereto. Each of the controller 180 and the main body 100 may include a communication module capable of wireless communication.

According to an aspect of the disclosure, referring to FIGS. 1 to 11, an embodiment of cleaner includes a main body 100. A suction fan 191 is disposed in the main body 100, and is configured to generate a suction force for sucking in air. A dust collector 192 is disposed in the main body 100 and is configured to separate foreign substances from the air that was sucked in. A filter housing 198 is detachably coupled to a rear of the main body 100. A filter 197 is in the filter housing 198 and is configured to filter the air from which foreign substances have been separated by the dust collector 192. A controller 180 is detachably coupled to a rear of the filter housing 198. The controller 180 includes a manipulation unit 181 to receive a manipulation input from a user to control an operation of the cleaner and/or an indication unit 182 to display information about an operating state of the cleaner.

The filter housing 198 may be configured to be detachable from the rear of the main body 100 in a backward direction X. A form factor of the controller 180 is greater than a corresponding form factor of the filter housing 198, as shown in FIGS. 7A to 7E.

Referring to FIGS. 1 to 11, an embodiment of the cleaner may include a socket 300 detachably coupling the controller 180 to the rear of the filter housing 198. The socket 300 may be in the filter housing 198. A first guide 320 may be provided in the socket 300. A second guide 184 may be provided in the controller 180. The second guide 184 may have a shape complementary to a shape of the first guide 320 so as to be guidable by the first guide 320 to couple and detach the controller 180 to the rear of the filter housing 198. The controller 180 may be configured to be coupled to, and detached from, the socket 300 by being slid in an upward direction and a downward direction, respectively.

Referring to FIGS. 6 and 8, an embodiment of the cleaner may include a handle 105 that is grippable by a user. When the controller 180 is coupled to the rear of the filter housing 198, the controller 180 is above the handle 105. The controller 180 may include a locking unit 187. The locking unit 187 is configured to be inserted into the handle 105 upon the controller 180 being coupled to the rear of the filter housing 198. The locking unit 187 includes a locking hole 188. The handle 105 has a screw fastening hole 531. When the controller 180 is coupled to the rear of the filter housing 198, the screw fastening hole 531 is aligned with the locking hole 188. When the controller 180 is coupled to the rear of the filter housing 198, a screw 532 is screwed into the locking hole 188 through the screw fastening hole 531. A cover 533 may be detachably coupled to the handle 105 to cover the screw fastening hole 531.

Referring to FIG. 12, an embodiment of the cleaner may include a handle 105 that is grippable by a user. The controller 180 is coupled to the handle 105 so that, when the controller 180 is coupled to and detached from the rear of the filter housing 198, the handle 105 is configured to be coupled to and detached from the main body 100, respectively.

Referring to FIG. 13, an embodiment of the cleaner may include a handle 105 that is grippable by a user. The handle 105, the filter housing 198, and the controller 180 are coupleable together as a unit so that, when the handle 105, the filter housing 198, and the controller 180 are coupled together as a unit, the handle 105 and the filter housing are coupleable to and detachable from the main body 100 and the controller 180 is coupleable to and detachable from the rear of the filter housing 198.

Referring to FIG. 11, in an embodiment of the cleaner, the controller 180 and the filter housing 198 may be configured so that, while the controller 180 is coupled to the rear of the filter housing 198, the filter housing 198 is detachable from the main body 100.

According to an aspect of the disclosure, referring to FIGS. 14 to 20, an embodiment of a cleaner includes a main body 100. A suction fan 191 is disposed in the main body 100, and is configured to generate a suction force for sucking in air. A dust collector 192 is disposed in the main body 100 and is configured to separate foreign substances from the air that was sucked in. A filter housing 198 is detachably coupled to the main body 100. The filter housing 198 is configured to be detachable from the main body 100 in a backward direction X. A filter 197 is in the filter housing 198 and is configured to filter the air from which foreign substances have been separated by the dust collector 192. The cleaner includes a controller 180 including a manipulation unit 181 to receive a manipulation input from a user to control an operation of the cleaner and/or an indication unit 182 to display information about an operating state of the cleaner. The controller 180 is located at a rear of the filter housing 198. The controller 180 is switchable between a use position 180Y1 and a retreat position 180Y2 in which the controller 180 does not interfere with the filter housing 198 being detached from the main body 100 in the backward direction X.

Referring to FIGS. 14-17, in an embodiment of the cleaner, the controller 180 may be rotatable to the use position 180Y1 and the retreat position 180Y2. An embodiment of the cleaner may include a hinge 108 or 108*a* that includes a shaft and is configured to rotate the controller 180 forward and backward to the use position 180Y1 and the retreat position 180Y2, respectively. An embodiment of the cleaner may include a hinge 108*c* that includes a shaft and is configured to rotate the controller 180 in a lateral direction to the use position 180Y1 and the retreat position 180Y2.

Referring to FIG. 16, an embodiment of the cleaner may include a handle 105 that is grippable by a user. The controller 180 may be coupled to the handle 105. Referring to FIG. 18, the handle 105 may be rotatably supported by the main body 100. The controller 180 may be configured to switch to the use position 180Y1 and the retreat position 180Y2 as the handle 105 is rotated.

Referring to FIGS. 19 and 20, in an embodiment of the cleaner, the controller 180 may have a flexible structure so as to be bendable from the use position 180Y1 to the retreat position 180Y2.

A cleaner according to an aspect of the disclosure includes a main body including a suction fan to generate a suction force for sucking in air, a dust collector to separate foreign substances from the sucked-in air, and a filter to filter foreign substances out of the air that has passed through the dust collector and the suction fan, a filter housing supporting the filter, and a controller that is configured to control an operation of the cleaner, is located at the rear of the filter housing, and is attachable to and detachable from the main body.

In an embodiment of the disclosure, the filter housing is detachable from the main body in the backward direction.

In an embodiment of the disclosure, at least one of form factors of the controller may be greater than a corresponding form factor of the filter housing.

In an embodiment of the disclosure, a socket by which the controller is detachably supported may be provided in the main body.

In an embodiment of the disclosure, the socket may be provided in the filter housing.

In an embodiment of the disclosure, the cleaner may further include a first guide arranged in the socket and extending in directions of attachment and detachment of the controller, and a second guide that is arranged in the controller, has a shape complementary to a shape of the first guide, and is to be guided by the first guide.

In an embodiment of the disclosure, the controller may be attached to and detached from the socket by being slid in the upward direction and the downward direction, respectively.

In an embodiment of the disclosure, the main body may further include a handle capable of being gripped by a user. The controller may be located above the handle and at the rear of the filter housing.

In an embodiment of the disclosure, the controller may include a locking unit that is to be inserted into the handle upon the controller being attached to the main body, and includes a locking hole. A screw fastening hole to be aligned with the locking hole may be provided in the handle. The controller may be fixed to the main body by tightening a screw into the locking hole through the screw fastening hole.

In an embodiment of the disclosure, the cleaner may further include a cover detachably coupled to the handle to cover the screw fastening hole.

In an embodiment of the disclosure, the main body may further include a handle capable of being gripped by a user. The controller may be coupled to the handle and is attachable to and detachable from the main body together with the handle.

In an embodiment of the disclosure, the main body may further include a handle capable of being gripped by a user. The handle, the filter housing, and the controller may be integrally attachable to and detachable from the main body.

In an embodiment of the disclosure, the controller may be coupled to the filter housing and is attachable to and detachable from the main body together with the filter housing.

A cleaner according to an aspect of the disclosure includes a main body including a suction fan to generate a suction force for sucking in air, a dust collector to separate foreign substances from the sucked-in air, and a filter to filter foreign substances out of the air that has passed through the dust collector and the suction fan, a filter housing that supports the filter and is supported in the main body to be detachable from the main body in a backward direction, and a controller that is located at the rear of the filter housing and is able to switch between a use position and a retreat position in which the controller does not interfere with the filter housing being detached from the main body in the backward direction.

In an embodiment of the disclosure, the controller is able to be rotated to the use position and the retreat position.

In an embodiment of the disclosure, the controller is able to be rotated to the use position and the retreat position by a hinge including a shaft in the forward or backward direction.

In an embodiment of the disclosure, the controller is able to be rotated to the use position and the retreat position by a hinge including a shaft in the lateral direction.

In an embodiment of the disclosure, the main body may further include a handle capable of being gripped by a user. The controller may be supported by the handle.

In an embodiment of the disclosure, the handle may be rotatably supported by the main body. The controller may be switched to the use position and the retreat position as the handle is rotated.

In an embodiment of the disclosure, the controller may have a flexible structure to be able to be bent from the use position to the retreat position.

For the purposes of promoting understanding of the disclosure, reference numerals are used in the preferred embodiments of the disclosure illustrated in the drawings, and particular terms are used to describe the embodiments of the disclosure, however, the disclosure is not limited by the terms and should be construed to encompass all components that would normally occur to those skilled in the art.

Particular executions described herein are merely examples and do not limit the scope of the disclosure in any way. For the sake of brevity, related-art electronics, control systems, software and other functional aspects of the systems may not be described in detail. Furthermore, line connections or connection members between elements depicted in the drawings represent functional connections and/or physical or circuit connections by way of example, and in actual applications, they may be replaced or embodied with various suitable additional functional connections, physical connections, or circuit connections. In addition, no item or component is essential to the practice of the disclosure unless the item or component is specifically described as being "essential" or "critical". As used herein, the term such as "comprising", "including" and the like are used to be understood as being an open-ended term for describing an embodiment of the disclosure.

The use of the terms "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the operations of the methods described herein may be performed in any suitable order unless otherwise indicated herein or otherwise clearly contradicted by context. The disclosure is not limited to the described order of the operations. The use of any and all examples, or exemplary language (e.g., 'and the like') provided herein, is intended merely to better illuminate the disclosure and does not pose a limitation on the scope of the disclosure unless otherwise claimed. Furthermore, various changes and modifications will be readily apparent to one of ordinary skill in the art without departing from the spirit and scope of the disclosure.

The invention claimed is:

1. A cleaner comprising:

a main body;

a suction fan in the main body and including a suction motor, and an impeller configured to be rotated by the suction motor to generate a suction force for sucking in air and thereby generate an air flow, wherein the impeller is downstream of the suction motor with respect to a direction of the air flow;

a dust collector in the main body in front of the suction fan and configured to separate foreign substances from the air that was sucked in;

a filter housing detachably coupled to a rear of the main body and configured to be detachable from the rear of the main body in a backward direction;

a filter in the filter housing and configured to filter the air from which foreign substances have been separated by the dust collector;

a controller to control an operation of the cleaner; and a socket provided at a rear of the filter housing and including an accommodation unit to accommodate the controller, wherein the controller is detachable from the accommodation unit of the socket in an upward direction to allow the filter housing to be detachable from the rear of the main body in the backward direction together with the socket.

2. The cleaner of claim 1, wherein the controller includes at least one of a manipulation unit to receive a manipulation input from a user to control an operation of the cleaner and an indication unit to display information about an operating state of the cleaner.

3. The cleaner of claim 1, wherein the socket is integral with the filter housing.

4. The cleaner of claim 1, a first connector at a lower end of the controller; and a second connector in the main body to be exposed to an inside of the accommodation until through an opening provided in a lower wall of the accommodation unit, wherein, when the controller is inserted into the accommodation unit, the first connector engages the second connector such that the controller communicates with the main body.

5. The cleaner of claim 1, further comprising:

a first guide in the socket; and a second guide in the controller and being guidable by the first guide to couple and detach the controller to the accommodation unit of the socket.

6. The cleaner of claim 1, wherein the controller is configured to be coupled to the socket by being slid in a downward direction.

7. The cleaner of claim 1, further comprising:

a handle that is grippable by a user, wherein the controller, when coupled to the socket, is above the handle.

8. The cleaner of claim 7, wherein the controller includes a locking unit configured to be inserted into the handle upon the controller being coupled to the socket, and a locking hole, the handle has a screw fastening hole that, when the controller is coupled to the socket, is aligned with the locking hole, and the cleaner further comprises a screw, that, when the controller is coupled to the rear of the filter housing, is screwed into the locking hole through the screw fastening hole.

9. The cleaner of claim 8, further comprising:

a cover detachably coupled to the handle to cover the screw fastening hole.

10. A cleaner comprising:

a main body;

a suction fan in the main body and including a suction motor, and an impeller configured to be rotated by the suction motor to generate a suction force for sucking in air and thereby generate an air flow, wherein the impeller is downstream of the suction motor with respect to a direction of the air flow;

a dust collector in the main body in front of the suction fan and configured to separate foreign substances from the air that was sucked in;

a filter housing detachably coupled to a rear of the main body and configured to be detachable from the rear of the main body in a backward direction;

a filter in the filter housing and configured to filter the air from which foreign substances have been separated by the dust collector;

a controller detachably coupled to a rear of the filter housing; and a handle that is grippable by a user, wherein the controller is coupled to the handle so that, when the controller is coupled to and detached from the rear of the filter housing, the handle is configured to be coupled to and detached from the main body, respectively.

11. A cleaner comprising:

a main body;

a suction fan in the main body and including a suction motor, and an impeller configured to be rotated by the suction motor to generate a suction force for sucking in air and thereby generate an air flow, wherein the impeller is downstream of the suction motor with respect to a direction of the air flow;

a dust collector in the main body in front of the suction fan and configured to separate foreign substances from the air that was sucked in;

a filter housing detachably coupled to a rear of the main body and configured to be detachable from the rear of the main body in a backward direction;

a filter in the filter housing and configured to filter the air from which foreign substances have been separated by the dust collector;

a controller detachably coupled to a rear of the filter housing; and a handle that is grippable by a user, wherein the handle, the filter housing, and the controller are coupleable together as a unit so that, when the handle, the filter housing, and the controller are coupled together as a unit, the handle and the filter housing are coupleable to and detachable from the main body and the controller is coupleable to and detachable from the rear of the filter housing.

12. A cleaner comprising:

a main body;

a suction fan in the main body and including a suction motor, and an impeller configured to be rotated by the suction motor to generate a suction force for sucking in air and thereby generate an air flow, wherein the impeller is downstream of the suction motor with respect to a direction of the air flow;

a dust collector in the main body in front of the suction fan and configured to separate foreign substances from the air that was sucked in;

a filter housing detachably coupled to a rear of the main body and configured to be detachable from the rear of the main body in a backward direction;

a filter in the filter housing and configured to filter the air from which foreign substances have been separated by the dust collector; and a controller detachably coupled to a rear of the filter housing, wherein the controller and the filter housing are configured so that, while the controller is coupled to the rear of the filter housing, the filter housing is detachable from the main body.

13. A cleaner comprising:

a main body;

a suction fan in the main body and configured to generate a suction force for sucking in air;

a dust collector in the main body and configured to separate foreign substances from the air that was sucked in;

a filter housing coupled to the main body and configured to be detachable from the main body in a backward direction;

a filter in the filter housing and configured to filter the air from which foreign substances have been separated by the dust collector; and a controller including a manipulation unit to receive a manipulation input from a user to control an operation of the cleaner and/or an indication unit to display information about an operating state of the cleaner, wherein the controller is located at a rear of the filter housing, and, the controller is rotatable between a use position and a retreat position in which the controller does not interfere with the filter housing being detached from the main body in the backward direction.

14. The cleaner of claim 13, further comprising:

a handle that is grippable by a user, wherein the controller is coupled to the handle.

15. The cleaner of claim 14, wherein the handle is rotatably supported by the main body, and the controller is configured to switch to the use position and the retreat position as the handle is rotated.

16. A cleaner comprising:

a main body;

a suction fan in the main body and configured to generate a suction force for sucking in air;

a dust collector in the main body and configured to separate foreign substances from the air that was sucked in;

a filter housing coupled to the main body and configured to be detachable from the main body in a backward direction;

a filter in the filter housing and configured to filter the air from which foreign substances have been separated by the dust collector; and a controller including a manipulation unit to receive a manipulation input from a user to control an operation of the cleaner and/or an indication unit to display information about an operating state of the cleaner, wherein the controller is located at a rear of the filter housing and is rotatable between a use position and a retreat position in which the controller does not interfere with the filter housing being detached from the main body in the backward direction; and a hinge that includes a shaft and is configured to rotate the controller forward and backward to the use position and the retreat position, respectively.

17. A cleaner comprising:

a main body;

a suction fan in the main body and configured to generate a suction force for sucking in air;

a dust collector in the main body and configured to separate foreign substances from the air that was sucked in;

a filter housing coupled to the main body and configured to be detachable from the main body in a backward direction;

a filter in the filter housing and configured to filter the air from which foreign substances have been separated by the dust collector; and a controller including a manipulation unit to receive a manipulation input from a user to control an operation of the cleaner and/or an indication unit to display information about an operating state of the cleaner, wherein the controller is located at a rear of the filter housing and is rotatable between a use position and a retreat position in which the controller does not interfere with the filter housing being detached from the main body in the backward direction; and a hinge that includes a shaft and is configured to rotate the controller in a lateral direction to the use position and the retreat position.

18. A cleaner comprising:

a main body;

a suction fan in the main body and configured to generate a suction force for sucking in air;

a dust collector in the main body and configured to separate foreign substances from the air that was sucked in;

a filter housing coupled to the main body and configured to be detachable from the main body in a backward direction;

a filter in the filter housing and configured to filter the air from which foreign substances have been separated by the dust collector; and a controller including a manipulation unit to receive a manipulation input from a user to control an operation of the cleaner and/or an indication unit to display information about an operating state of the cleaner, wherein the controller is located at a rear of the filter housing and has a flexible structure so as to be bendable to switch the controller between a use position and a retreat position in which the controller does not interfere with the filter housing being detached from the main body in the backward direction.

* * * * *